US007782168B2

(12) United States Patent
Nakatsu et al.

(10) Patent No.: US 7,782,168 B2
(45) Date of Patent: Aug. 24, 2010

(54) REACTOR PART

(75) Inventors: Ryo Nakatsu, Saitama (JP); Kensuke Maeno, Saitama (JP)

(73) Assignee: Tamura Corporation, Tokyo (JP)

( * ) Notice: Subject to any disclaimer, the term of this patent is extended or adjusted under 35 U.S.C. 154(b) by 34 days.

(21) Appl. No.: 12/223,618

(22) PCT Filed: Feb. 6, 2007

(86) PCT No.: PCT/JP2007/000059

§ 371 (c)(1),
(2), (4) Date: Aug. 5, 2008

(87) PCT Pub. No.: WO2007/091388

PCT Pub. Date: Aug. 16, 2007

(65) Prior Publication Data

US 2009/0027151 A1 Jan. 29, 2009

(30) Foreign Application Priority Data

Feb. 9, 2006 (JP) ..... 2006-033079
Aug. 2, 2006 (JP) ..... 2006-211499

(51) Int. Cl.

| | |
|---|---|
| ***H01F 17/04*** | (2006.01) |
| ***H01F 21/02*** | (2006.01) |
| ***H01F 27/28*** | (2006.01) |
| ***H01F 27/24*** | (2006.01) |
| *H01F 27/02* | (2006.01) |
| *H01F 27/30* | (2006.01) |

(52) U.S. Cl. ..... 336/221; 336/90; 336/145; 336/182; 336/184; 336/196; 336/198; 336/229; 336/212

(58) Field of Classification Search ..... None
See application file for complete search history.

(56) References Cited

U.S. PATENT DOCUMENTS 2,149,634 A * 3/1939 Schweitzer, Jr. ..... 361/35

(Continued)

FOREIGN PATENT DOCUMENTS

JP 7-22258 1/1995

(Continued)

*Primary Examiner*—Elvin G Enad
*Assistant Examiner*—Mangtin Lian
(74) *Attorney, Agent, or Firm*—McGinn IP Law Group, PLLC

(57) ABSTRACT

A reactor part includes at least a winding and a magnetic substance core, in which the core includes a pair of winding portions around each the winding is wound, and a non-winding portion around which no winding is wound, wherein a cross-sectional area in a direction orthogonal to a magnetic path of the non-winding portion of the core is made smaller than a cross-sectional area in a direction orthogonal to a magnetic path of the each of winding portions.

17 Claims, 28 Drawing Sheets

U.S. PATENT DOCUMENTS

| | | | | |
|---|---|---|---|---|
| 2,762,988 | A * | 9/1956 | Pomazal et al. | 336/210 |
| 2,849,696 | A * | 8/1958 | Moynihan | 336/212 |
| 3,593,243 | A * | 7/1971 | Trump et al. | 336/60 |
| 4,447,795 | A * | 5/1984 | Sefko et al. | 336/178 |
| 5,587,694 | A * | 12/1996 | Minato et al. | 336/65 |
| 6,657,529 | B1 * | 12/2003 | Albach | 336/182 |
| 6,856,230 | B2 * | 2/2005 | Lu | 336/212 |
| 2002/0014941 | A1 * | 2/2002 | Yoshioka et al. | 336/184 |
| 2003/0030529 | A1 * | 2/2003 | Min et al. | 336/182 |

FOREIGN PATENT DOCUMENTS

| | | |
|---|---|---|
| JP | 11-273885 | 10/1999 |
| JP | 2003-47241 | 2/2003 |
| JP | 2003-124039 | 4/2003 |
| JP | 2004-327569 | 11/2004 |
| JP | 2005-50918 | 2/2005 |
| JP | 2005-150517 | 6/2005 |

* cited by examiner

Related Art

FIG 5

| | 0A | 50A | 100A | 130A | 160A | 200A | 240A | 270A | 300A | 330A | 360A | 390A | 420A | 450A |
|---|---|---|---|---|---|---|---|---|---|---|---|---|---|---|
| EXAMPLE 6 CORE WIDTH 18mm | 253 | 253 | 253 | 248 | 235 | 200 | 158 | 128 | 113.1 | 96.3 | 83.2 | 70 | 61.2 | 51.9 |
| EXAMPLE 5 CORE WIDTH 18.5mm | 253 | 253 | 253 | 250 | 238 | 205 | 164 | 124 | 110 | 91.1 | 80.2 | 65.5 | 54.7 | 47.5 |
| EXAMPLE 4 CORE WIDTH 19mm | 258 | 258 | 258 | 258 | 242 | 206 | 164 | 128 | 112 | 88 | 72 | 60 | 54 | 46 |
| EXAMPLE 3 CORE WIDTH 19.5mm | 258 | 258 | 258 | 258 | 246 | 207 | 164 | 129 | 112 | 88 | 72 | 60 | 54 | 46 |
| EXAMPLE 2 CORE WIDTH 20mm | 258 | 258 | 258 | 255 | 253 | 211 | 166 | 129 | 108 | 85 | 66 | 60 | 53 | 45 |
| EXAMPLE 1 CORE WIDTH 20.5mm | 258 | 258 | 258 | 255 | 253 | 213 | 166 | 133 | 108 | 83 | 66 | 59 | 53 | 45 |
| COMPARATIVE EXAMPLE CORE WIDTH 27mm | 260 | 260 | 260 | 258 | 255 | 220 | 180 | 150 | 115 | 80 | 65 | 60 | 53 | 45 |

FIG 7

| | 0A | 50A | 100A | 130A | 160A | 200A | 240A | 270A | 300A | 330A | 360A | 390A | 420A | 450A |
|---|---|---|---|---|---|---|---|---|---|---|---|---|---|---|
| EXAMPLE 9 CORE WIDTH 5mm | 230 | 193 | 141 | 135 | 132 | 129 | 127 | 126 | 125 | 120 | 114 | 112 | 109 | 97 |
| EXAMPLE 8 CORE WIDTH 10mm | 240 | 239 | 223 | 172 | 143 | 138 | 129 | 126 | 120 | 115 | 112 | 104 | 90 | 71 |
| EXAMPLE 7 CORE WIDTH 15mm | 250 | 250 | 250 | 241 | 200 | 158 | 138 | 122 | 120 | 108 | 84 | 77 | 70 | 59 |
| EXAMPLE 6 CORE WIDTH 18mm | 253 | 253 | 253 | 248 | 235 | 200 | 158 | 128 | 113.1 | 96.3 | 83.2 | 70 | 61.2 | 51.9 |
| EXAMPLE 5 CORE WIDTH 18.5mm | 253 | 253 | 253 | 250 | 238 | 205 | 164 | 124 | 110 | 91.1 | 80.2 | 65.5 | 54.7 | 47.5 |
| EXAMPLE 4 CORE WIDTH 19mm | 258 | 258 | 258 | 258 | 242 | 206 | 164 | 128 | 112 | 88 | 72 | 60 | 54 | 46 |
| EXAMPLE 3 CORE WIDTH 19.5mm | 258 | 258 | 258 | 258 | 246 | 207 | 164 | 129 | 112 | 88 | 72 | 60 | 54 | 46 |
| EXAMPLE 2 CORE WIDTH 20mm | 258 | 258 | 258 | 255 | 253 | 211 | 166 | 129 | 108 | 85 | 66 | 60 | 53 | 45 |
| EXAMPLE 1 CORE WIDTH 20.5mm | 258 | 258 | 258 | 255 | 253 | 213 | 166 | 133 | 108 | 83 | 66 | 59 | 53 | 45 |
| COMPARATIVE EXAMPLE CORE WIDTH 27mm | 260 | 260 | 260 | 258 | 255 | 220 | 180 | 150 | 115 | 80 | 65 | 60 | 53 | 45 |

FIG 11

【 INDUCTANCE COMPARISON 】

| INDUCTANCE | 15mm | 12.5mm WIDTH | 10mm WIDTH |
|---|---|---|---|
| | (μH) | (μH) | (μH) |
| SAMPLE No. 1 | 625 | 620 | 591 |
| SAMPLE No. 2 | 630 | 628 | 593 |
| SAMPLE No. 3 | 628 | 628 | 590 |
| AVERAGE | 627. 7 | 625. 3 | 591. 3 |

FIG 12

[ COMPARISON OF TEMPERATURE RISE ]

| TEMPERATURE RISE | 15mm WIDTH | | 12.5mm WIDTH | | 10mm WIDTH | |
|---|---|---|---|---|---|---|
| | MEASURED VALUE (°C) | Δt(°C) | MEASURED VALUE (°C) | Δt(°C) | MEASURED VALUE (°C) | Δt(°C) |
| (1) BETWEEN COILS | 105.4 | 73.9 | 104.0 | 76.1 | 112.9 | 83.9 |
| (2) COIL SURFACE | 98.7 | 67.2 | 93.6 | 65.7 | 107.9 | 78.9 |
| (3) REACTOR UPPER SURFACE | 87.5 | 56.0 | 85.8 | 57.9 | 93.6 | 64.6 |
| (4) AMBIENT TEMPERATURE | 31.5 | — | 27.9 | — | 29.0 | — |

REACTOR PART

TECHNICAL FIELD

The present invention relates to a reactor part capable of miniaturizing a shape of a core of a reactor which enables the improvement of a DC (Direct Current) superimposition characteristic of a high current value and also the achievement of miniaturization, light-weight, low-costs of the reactor part as a whole.

BACKGROUND TECHNOLOGY

The reactor is used in various applications. The representative reactor includes a series reactor connected serially to an electric motor circuit to limit a current when a short circuit occurs, a parallel reactor to stabilize a current share among parallel circuits, a current-limiting reactor to limit a current when a short circuit occurs and to protect a machine connected thereto, a starting reactor connected serially to the electric motor circuit to limit a starting current, a shunt reactor connected in parallel to a transmission line to compensate for leading reactive power or to suppress an abnormal voltage, a neutral point reactor connected between the neutral point and the ground to limit a ground fault current flowing when a ground fault accident of an electric power system occurs, and an arc-extinguishing reactor to automatically extinguish electric arc appearing when one-line ground fault of a three phase electric power system occurs, or a like.

It is requested that electrical specifications of electrical parts such as a transformer, choke coil, or a like including a reactor be satisfied in relation to electrical circuits or a like to be used. In particular, when a reactor is used as a boosting reactor or a like in a high current circuit, it is important that specifications related to DC superimposition characteristics of a high current value are satisfied.

FIG. 1 is a perspective view showing a core of a conventional reactor part. The conventional core 9 is made up of, for example, sheet members 6 to be inserted as a member for a magnetic gap among each of several magnetic substance blocks 3*a* and several magnetic substance blocks 3*b*. The core 9 is of an approximately ring-like shape as a whole and has two straight line portions made up of the magnetic substance blocks 3*b* in which a winding (not shown) is wound around each straight line portion with a winding frame portion of a bobbin (not shown) interposed between each winding and the straight line portions to obtain specified electric characteristics. Each of the blocks 3*a* made of a magnetic substance is coupled to each of the straight line portions of the blocks so that the core 9 has the approximately ring-like shape.

Incidentally, the conventional core 9 has a core shape having a cross-sectional core area being uniform relative to a magnetic path (for example, Patent Reference 1). That is, the core 9 shown in FIG. 1 is so configured that the height Ha of the block 3*a* made of the magnetic substance is equal to the height Hb of the block 3*b* made of the magnetic substance and that the width Wa of the block 3*a* made of the magnetic substance is equal to the width Wb of the block 3*b* made of the magnetic substance. Therefore, the core 9 is constructed so that a cross-sectional area in a direction orthogonal to a magnetic path of the magnetic substance block 3*b* making up the winding portion around which the winding is wound is equal to the cross-sectional area in the direction orthogonal to the magnetic path of the magnetic substance block 3*a* making up a non-winding portion around which no winding is wound.

Patent Reference 1: Japanese Patent Application Laid-open No. 2003-124039

DISCLOSURE OF THE INVENTION

Problems to be Solved by the Invention

In the conventional reactor part described above, as shown in FIG. 1, the core 9 is configured so as to have a cross-sectional area being uniform relative to the magnetic path, causing the shape of the core 9 to become large which presents a problem in that costs are increased. The larger shape of the core 9 makes it difficult to achieve miniaturization and light-weight of the entire reactor and the core 9 is the highest-priced material out of materials for the reactor part, thus causing a difficulty in reducing costs for the entire reactor.

The first object of the present invention is to provide technology enabling the miniaturization, light-weight, and low-costs of the reactor as a whole by miniaturizing the core of the reactor part.

The second object of the present invention is to provide technology by which DC superimposition in a high current region can be improved by miniaturizing the shape of the core of the reactor part and, as a result, the reactor can be miniaturized, light-weight, and low costs as a whole by making the core shape small.

Means for Solving Problems

When a core of a reactor part is designed, conventionally, a magnetic path is designed so as to have the same cross-sectional shape. However, the inventor of the present invention has found that, by reducing portions through which almost no magnetic flux is made to pass, a DC superimposition characteristic in a high current region can be improved and an optimum core shape that can achieve the miniaturization of a core shape can be realized.

That is, in order to achieve the above object, a reactor part of the present invention includes at least a winding and a magnetic substance core, wherein the core includes a winding portion around which the winding is wound and a non-winding portion around which no winding is wound and wherein a cross-sectional area in a direction orthogonal to a magnetic path of the non-winding portion of the core is made smaller than a cross-sectional area in a direction orthogonal to the magnetic path of the winding portion.

By configuring as above, owing to the miniaturization of a core shape of the reactor part, the miniaturization, light-weight, and low-cost of the entire reactor can be made possible. Moreover, while the core shape of the reactor part is made small, the DC superimposition characteristic in the region of high currents can be improved.

In this case, by making a cross-sectional area in a direction orthogonal to a magnetic path of the non-winding portion of the core smaller than a cross-sectional area in a direction orthogonal to a magnetic path of the winding portion, it is thought that magnetic saturation occurs earlier in the non-winding portion rather than in the winding portion and, as a result, the DC superimposition in the high current region is improved.

Moreover, a cross-sectional area of the non-winding portion is larger by about 0.76 times to about 0.67 times than a cross-sectional area of the winding portion. By configuring as above, the core as a reactor part, that is, the rector can be miniaturized, made light-weight, and made low-cost, while the DC superimposition in the high current region can be improved.

The reactor part includes at least a winding and a magnetic substance core, wherein the core is made up of a winding portion around which the winding is wound and a non-winding portion around which no winding is wound, wherein the winding portion has at least two magnetic substance blocks each having a rectangular and plane shape arranged in parallel with an interval interposed between one another and two non-winding portions each made up of the approximately trapezoidal or triangular magnetic substance block are arranged in a manner in which the two approximately trapezoidal or triangular magnetic substance blocks of the non-winding portion sandwiches the magnetic substance blocks making up the winding portion by each of approximately trapezoidal or triangular bottoms of the non-winding portions so as to be faced one another and a cross-sectional area in a direction orthogonal to a magnetic path of an approximately trapezoidal or triangular crest portion of each of the magnetic substance blocks making up the non-winding portion is made smaller than a cross-sectional area in a direction orthogonal to a magnetic path of each of the magnetic substance blocks making up the winding portion. By configuring as above, when compared with the case where the non-winding portion is made up of U-typed or rectangular type magnetic blocks, a volume of each of the magnetic substance blocks can be made small. Therefore, the further miniaturization, light weight, and low-costs of the core as the reactor part, that is, the reactor can be achieved.

The core of the present invention may be divided into eight portions with a magnetic gap interposed among blocks. By configuring as above, the improvement of the DC superimposition corresponding to an amount of reduction of the cross-sectional area of the non-winding portion becomes remarkable.

Moreover, the reactor part is used as a vehicle-mounted type reactor. There is a fear of flowing of a large current in a vehicle-mounted type reactor due to a failure of a circuit occurring when vehicle accidents or the like happen and, therefore, the use of the reactor part of the present invention for the vehicle-mounted type reactor enables high impedance to be obtained in the high current region, which can enhance safety.

BEST MODE OF CARRYING OUT THE INVENTION

The reactor part of the first embodiment of the present invention is described by referring to drawings. FIG. 2 is a perspective view showing one example of the reactor including the reactor part of the present invention.

The reactor 10 shown in FIG. 2 is used in, for example, an electrical circuit of a device having a forced cooling means in which the winding is wound around the bobbin 4 and, after having housed the reactor part formed by inserting the core 109 (see FIG. 4) described later in the bobbin 4 into a thermal conductive case 1, a filler 8 is poured to secure the reactor part. A coating is peeled off the lead portion 5 to keep the conductor uncoated and an unillustrated solderless terminal is provided to be connected to other electrical components or a like. Incidentally, the notch 12 to be used for the lead portion 5 in the thermal conductive case 1 is formed in order to prevent the interference occurring between the lead portion 5 and the thermal conductive case 1 and the thermal conductive case 1 is generally made of metal and, therefore, an insulator is inserted into the notch 12 for the lead portion 5 in order to provide insulation between the lead portion 5 and the thermal conductive case 1. The holes 13 for securing the reactor formed at four corners of the thermal conductive case 1 serve as screw holes to secure the thermal conductive case 1 to, for example, a forcedly cooled cabinet or a like.

FIG. 3 is an exploded perspective view of the reactor shown in FIG. 2. As shown in FIG. 3, the thermal conductive case 1 includes the thermal conductive case bottom 11 and thermal conductive case bottom 14 being shallower in depth than the thermal conductive case bottom 11 and having a step portion therein. In the reactor 10 shown in FIG. 2, the insulating sheet 7 is placed at the thermal conductive bottom 11 and the reactor part formed by winding the winding 2 around the bobbin 4 and by inserting the core 109 (see FIG. 4 for detail) into the bobbin 4 is housed therein. After the reactor part is housed in the reactor 10, the thermal conductive case bottom 11 comes into contact with a rear (not shown) of the winding 2 making up the reactor part and the thermal conductive case bottom 14 comes into contact with the block rear of the core 109. The insulating sheet 7 is inserted between the thermal conductive case bottom 11 and windings 2 to provide electrical insulation between the thermal conductive case 1 and the winding 2. After the reactor part is housed in the reactor 5, the filer 8 is poured therein to secure the reactor part to the thermal conductive case 1.

FIG. 4 is a diagram showing a shape of the reactor part of the embodiment and FIG. 4(*a*) is its plan view and FIG. 4(*b*) is its side view. As shown in FIG. 4(*a*) and FIG. 4(*b*), the core 109 of the reactor part of the embodiment is made up of two magnetic substance blocks 103*a*, six magnetic substance blocks 103*b*, and sheet members 106 inserted, as a member for a magnetic gap, among blocks 103*a* and 103*b*. That is, according to the embodiment, the core 109 includes six magnetic substance blocks 103*b* making up the winding portion around which the winding is wound (see FIG. 2 and FIG. 3) and two magnetic substance blocks 103*a* making up the non-winding portion around which no winding is wound, in which the winding 2 is wound around the six magnetic substance blocks 103*b* with the bobbin 4 shown in FIGS. 2 and 3 interposed between the blocks 103*a* and windings 2, which make up the winding portion, thus constituting the reactor part. As shown in FIG. 4(*a*) and FIG. 4(*b*), the core 109 of the reactor part has the ring-like shape as a whole and the six magnetic substance blocks 3*b* making up the winding portion described above are configured to form two straight line portions each being made up of three magnetic substance blocks 103*b* in which the winding is wound around each of the straight line portions with the winding frame portion of the bobbin 4 interposed therebetween, from which specified electrical characteristics can be obtained. Each of the two magnetic substance blocks 3*a* making up the non-winding portion described above is coupled to each of the two straight line portion each being made up of the three magnetic substance blocks 103*b*, thus making the core approximately ring-shaped. Incidentally, each of the sheet members 106 is inserted, as a member for a magnetic gap, into a coupling portion among the magnetic substance blocks 103*b* and into a coupling portion between each of the magnetic substance blocks 103*a* and each of the magnetic substance blocks 103*l*.

Here, in the core 109 of the reactor part of the embodiment, as shown in FIGS. 4(*a*) and 4(*b*), each of the magnetic substance blocks 103*b* has a cross-sectional core area, however, each of the magnetic substance blocks 103*a* has no cross-sectional area being uniform relative to the magnetic substance blocks 103*b*. That is, when a core of a reactor part is designed, in the core 9 of the conventional reactor part shown in FIG. 1, the magnetic path is designed so as to have the same cross-sectional shape. However, in the core 109 of the reactor part of the embodiment, a portion through which almost no magnetic flux in each of the magnetic substance block 103*a* is made to pass is reduced and a cross-sectional area in a direction orthogonal to a magnetic path in the two magnetic substance blocks 103 making up the non-winding portion of the core 109 is made to be smaller than the cross-sectional area in a direction orthogonal to the magnetic path of each of the magnetic substance blocks 103*b* making up the winding-portion.

Now, dimensions of each of magnetic substance blocks making up the core 109 of the embodiment are described. In each of the magnetic substance blocks 103*b*, a core width Wb shown in FIG. 4(*a*) is made to be 27.0 mm and a block length Lb is made to be 16.5 mm. On the other hand, in each of the magnetic substance blocks 103*a*, a block length La is made to be 72.0 mm and a core width W1*a* is made to be within a range of 20.5 mm to 18.0 mm. Moreover, both the height Ha of each of the magnetic substance blocks 103*a* and the height Hb of each of the magnetic substance blocks 103*b*, as shown in FIG. 4(*b*), are made to be 27.5 mm thus both having the same dimensions. Therefore, the cross-sectional area Wb*Hb in a direction orthogonal to the magnetic path of each of the magnetic substance blocks 103*b* making up the winding portion around which the winding is wound is 742.5 mm, while the cross-sectional area W1*aHa of each of the magnetic substance blocks 103***a* making up the non-winding portion around which no winding is wound is 563.75 mm to 495.0 mm. Therefore, the cross-sectional area W1*aHa in the direction orthogonal to the magnetic path of each of the magnetic substance blocks 103***a* making up the non-winding portion remains to be about 76% to about 67% (about 0.76 times to about 0.67 times) of the cross-sectional area Wb*Hb in the direction orthogonal to the magnetic path of each of the magnetic substance blocks 103*b* making up the winding portion. In other words, the cross-sectional area of each of the magnetic substance block 103*a* making up the non-winding portion is made smaller by about 24% to about 33% than the cross-sectional area Wb*Hb of each of the magnetic substance blocks 103*b* making up the winding portion. Incidentally, as shown in FIGS. 4(*a*) and 4(*b*), each of the magnetic substance blocks 103*a* is so formed that the cross-sectional area of its main portion except its both corner portions is approximately W1*a**H* and, therefore, by decreasing the cross-sectional area W1*aHa, the volume of each of the magnetic substance blocks 103***a* can be reduced greatly. The reduction of the volume of each of the two magnetic substance blocks 103*a* enables the miniaturization and low-costs of the core 109 as a whole.

Incidentally, the dash and dotted lines in FIGS. 4(*a*) and 4(*b*) show the shape of the core 109 taken when the core (block) width WCa of each of the magnetic substance blocks 103*a* is made to be 27.0 mm being the same as the core (block) width Wb of each of the magnetic substance blocks 103*b*, that is, the cross-sectional area WCa*Ha of each of the magnetic substance blocks 103*a* making up the non-winding portion is not made smaller than the cross-sectional Wb*Hb of each of the magnetic substance blocks 103 making up the winding portion. Moreover, the dotted lines in FIGS. 4(*a*) and (*b*) show that the width W2*a* of each of the magnetic substance blocks 103*a* is made further smaller, which is the shape of the core of the second embodiment of the present invention described later.

The table in FIG. 5, as described above, provides a listing of the core (block) width W/a of each of the magnetic substance blocks 103*a*, which is changed in a range between 20.5 mm and 18.00 mm, making up the reactor part containing the core 109 and of current values (A), and inductance value (μH) appearing for each of current values of the reactor having the reactor part. Incidentally, a comparative example is shown in the form of a graph in which the core (block) width the core (block) width WCa of each of the magnetic substance blocks 103*a* is 27.0 mm being the same as the core (block) width Wb of each of the magnetic substance blocks 103 as in the case of the conventional example. FIG. 6 shows these relations by the graph.

In FIGS. 5 and 6, the core (block) width W1*a* of each of the magnetic substance blocks 103*a* is changed in every 0.05 mm in a range between 20.5 mm to 18.00 mm, for example, to be 20.5 mm (example 1), 20.0 mm (example 2), 19.5 mm (example 3), 19.0 mm (example 4), and 18.5 mm (example 5), and 18.0 mm (Example 6) and inductance values (μH) of the reactor containing the reactor part using the core described above is calculated for current values in 14 steps from 0 (A) to 450 (A).

In particular, as is apparent from the graph in FIG. 6, in all the cases of the core (block) width of the example 1 to example 6, each of the inductance values (μH) is about 250 (μH) being approximately the same as in the case of the comparative example. Therefore, as in the case of the embodiment of the present invention, if the core (block) width W1*a* is reduced in the range of 20.5 mm to 18.00 mm, in the region of the comparatively low current in the range of 50 (A) to 160 (A), high inductance values can be obtained in the case where the core (block) width WCa is 27.0 mm. It is now confirmed that, if the core (block) width W1*a* is reduced in the range of 20.5 mm to 18.0 mm, as in the case where the width is not reduced at all, in the comparatively low current region in the range of 0 (A) to 160 (A), functions of the reactor can be fully performed.

Incidentally, as is apparent from the graph in FIG. 6, in all the cases of the core (block) width, in the region of the comparatively high current (between 300(A) and 450(A)), each of the inductance values (μH) is equal to values in the case of the comparative example or more than that. Therefore, as in the case of the embodiment of the present invention, if the core (block) width W1*a* is reduced in the range of 20.5 mm to 18.0 mm, in the region of the comparatively high current being larger than 300 (A), high inductance values being larger than values in the case where the core width is not reduced at all (the case where width WCa is 27.0 mm) can be obtained. It has been now confirmed that, as in the case of the embodiment of the present invention, if the core (block) width W1*a* is reduced in the range of 20.5 mm to 18.0 mm, when compared with the case where the width is not reduced at all, in the region of the comparatively high current being 300 (A) or more, the DC superimposition characteristic can be removed remarkably. That is, it has been also confirmed that, even when a comparatively high current being higher than 300 (A) flows, safety can be enhanced more when compared with the case where the width is not reduced at all. Therefore, by making the core (block) width W1*a* be in the range being larger by about 0.76 times to about 0.67 times than the core (block) width Wb, it is possible to achieve the miniaturization and low-costs of the reactor and to improve DC superimposition characteristic in the comparatively high current region. Moreover, in this case, by making the cross-sectional area W1*aHa in a direction orthogonal to the magnetic path of each of the magnetic substance blocks 103***a* making up the non-winding portion of the core 109 be made smaller than the cross-sectional area Wb*Hb in a direction orthogonal to the magnetic path of each of the magnetic substance blocks 103*a* making up the winding-portion, it is expected that magnetic saturation in the non-winding portion occurs earlier than in the winding portion and, as a result, it is thought that the DC superimposition is improved in the high current region.

The reactor of the embodiment is used in vehicles (for example, to be used for control of motor currents flowing in hybrid electric vehicles, the region of the comparatively low current (between 0 A to 160 A described above) is used as an ordinary use region. Moreover, in the case of a vehicle accident, there is a fear of momentary flowing of large currents and, therefore, in the region of the comparatively high currents being 300 A or more, it is very desirous from the view points of safety that a high inductance is obtained. Accordingly, as in the embodiment, by reducing the core (block) width W1*a* in the range of 20.5 mm to 18.0 mm, it is made possible to provide a core as the reactor part that can be used suitably for the vehicle-mounted type reactor.

Next, a reactor part of the second embodiment of the present invention will be described. Basic configurations of the reactor part and the reactor including the reactor part of the second embodiment are the same as those of the first embodiment shown in FIGS. 2 to 4. Therefore, the core 109 of the second embodiment is divided into 8 portions as a whole as in the first embodiment. On the other hand, the second embodiment is characterized in that an amount of reduction to be employed to make the cross-sectional area in a direction orthogonal to the magnetic path of the non-winding portion of the core 109 described above becomes smaller than the cross sectional are in a direction orthogonal to the magnetic path of the winding portion is increased more as compared with the case of the first embodiment. That is, the width W2*a* of the core (block) of the magnetic substance block 103*a* shown in FIG. 4(*a*) is formed so as to fall within the range of 15.0 mm to 5.0 mm.

The table in FIG. 7, as described above, provides a listing of the core (block) width W2*a* of each of the magnetic substance blocks 103*a*, which is changed in a range between 15.0 mm and 5. 00 mm, making up the reactor part containing the core 109 and of current values (A), and inductance values (μH) appearing for each of current values of the reactor having the reactor part for the first embodiment to sixth embodiment and additionally in the example 7 to example 9. Also, the comparative example in which the width WCa of the magnetic substance block 103*a* measured in the first embodiment is 27.0 mm is shown in the same manner. FIG. 8 shows these relations by the graph.

In FIGS. 7 and 8, the core (block) width W2*a* of each of the magnetic substance blocks 103*a* shown in FIG. 4 is changed in every 5 mm in a range between 15.0 mm to 5.0 mm, for example, to be 15.0 mm (example 7), 10.0 mm (example 8), 5.0 mm (example 9), and inductance values (μH) of the reactor containing the reactor part using the core described above is calculated for current values in 14 steps from 0 (A) to 450 (A).

Particularly, as is apparent from the table in FIG. 7, in the case of the core (block) width in the example 9, the inductance value (μH) decreases immediately when the current reaches 50 (A) while the reactor is operating except the non-operation while the reactor is not operating. Also, in the case of the core (block) width of the example 8, when the current reaches 130 (A) and thereafter, the inductance value (μH) remarkably decreases. Moreover, in the case of the core (block) width of the example 7, when the current reaches 200 (A) and, thereafter, the inductance value (μH) remarkably decreases. On the other hand, as is apparent from the graph in FIG. 8, in the core (block) width of all the example 8, and example 9, in the region of the comparatively high current being 300 (A) or more (300 A to 450 A), the inductance of each of the examples are remarkably high as compared with that in the comparative example. Therefore, the core (block) width 2*a* in the range of 15.0 mm to 5.0 mm is reduced and, as a result, in the region of the comparatively high current being 300 (A) or more, greatly high inductance value can be obtained as compared with the case where the width is not reduced at all (when the core (block) width WCa is 27.0 mm). Thus, it has now been confirmed that, if the core (block) width W2*a* of the embodiment is reduced in the range of 15.0 mm to 5.0 mm, in the region of the comparatively high current being 300 (A) or more, the DC superimposition can be improved. That is, it has now been confirmed that, even when a comparatively high current being 300 (A) flows, safety of the reactor is enhanced when compared with the case where the width is not reduced at all. Therefore, by making the core (block) width W2*a* be in the range being larger by about 0.76 times to about 0.67 times than the core (block) width Wb, it is possible to achieve the miniaturization and low-costs of the reactor and to improve DC superimposition characteristic in the comparatively high current region. Moreover, in this case, by making the cross-sectional area W2*aHa in a direction orthogonal to the magnetic path of each of the magnetic substance blocks 103***a* making up the non-winding portion of the core 109 be smaller than the cross-sectional area Wb*Hb in a direction orthogonal to the magnetic path of each of the magnetic substance blocks 103*a* making up the winding-portion, it is expected that magnetic saturation in the non-winding portion occurs earlier than in the winding portion and, as a result, it is thought that the DC superimposition is improved in the high current region.

Incidentally, in the case of the core (block) width of the example 7, in the region of the comparatively high current value being between 0 (A) to 130 (A), the inductance is 240 (μH). If the core (block) width W2*a* is reduced to 15.0 mm, in the region of the comparatively low current being 0 (A) to 130 (A), as in the case where the width is not reduced at all (the core (block) width WCa is 27.0 mm) or as in the case of the first embodiment where the width is reduced in the range of 20.5 mm to 18.0 mm, high inductance can be obtained. Therefore, if the core (block) width W2*a* is reduced to 15.0 mm, in the region of the comparatively low current being between 0 (A) to 130 (A), the function of the reactor can be fully performed.

Next, a reactor part of the third embodiment of the present invention will be described. FIGS. 9 and 10 show basic configurations of the reactor part and a reactor having the reactor part of the third embodiment. FIG. 9 is a plan view showing a shape of the core of the reactor part of the third embodiment. FIG. 10 is a diagram showing the reactor including the core 119. As shown in FIG. 9, the core 119 of the reactor part of the third embodiment differs from those in the first and second embodiments in that the core 119 is divided into 4 portions as a whole. The core 119 of the reactor part of the third embodiment includes two magnetic substance blocks 113*a* and two magnetic substance blocks 113*b* and the sheet member 116 inserted as a member for a magnetic gap among the blocks. That is, the core 119 of the third embodiment includes two magnetic substance blocks 113*b* making up a winding-portion around which the winding 112 is wound and two magnetic substance blocks 113*a* making up the non-winding portion around which no winding is wound, wherein the winding is wound around the two magnetic substance blocks 113*b* making up the winding-portion with a nonillustrated bobbin constituting the reactor part, which enables specified electrical characteristics to be obtained. Moreover, the sheet material 116 is inserted, as a member for a magnetic gap, into a coupling portion between each of the magnetic substance block 113*a* and each of the magnetic substance blocks 113*b*.

Here, as shown in FIG. 9, in the core 119 of the reactor part of the third embodiment, each of the magnetic substance blocks 113*b* has a uniform core cross-sectional area, however, each of the magnetic substance blocks 113*a* does not have a core cross-sectional area being uniform relative to each of the magnetic substance blocks 113*b*. That is, unlike the conventional case where a magnetic path is designed so as to have the same cross-sectional area, in the core 119 of the reactor part of the third embodiment, portions where almost no magnetic flux is made to pass in each of the magnetic substance blocks 113*a* and a cross-sectional area in a direction orthogonal to the magnetic path in the two magnetic substance blocks 113*a* making up the non-winding portion of the core 119 is made smaller than that in a direction orthogonal to the magnetic path in the two magnetic substance blocks 113*b* making up the winding-portion.

Now, in the third embodiment, the core (block) width W3*b* of each of the magnetic substance blocks 113*b* is 15.0 mm, while the core (block) width W3*a* of each of the magnetic substance blocks 113*a* is made to be reduced from 15.0 mm to 12.5 mm and 10.0 mm. Moreover, though not shown in FIG. 9, the height H3*a* of each of the magnetic substance blocks 113*a* is the same as the height H3*b* of each of the magnetic substance blocks 113*b*. Therefore, the cross-sectional area W3*aH3***a* of each of the magnetic substance blocks 113*a* making up the non-winding portion around which no winding is wound remains larger about 0.83 times and about 0.67 times respectively than the cross-sectional areas W3*bH3***b* in the direction orthogonal to the magnetic path of each of the magnetic substance blocks 113*b* making up the winding-portion around which the winding is wound. In other words, the cross-sectional areas W3*aH3***a* of each of the magnetic substance blocks 113*a* making up the non-winding portion around which no winding is wound is made to be reduced by about 17% and about 33% respectively from the cross-sectional area W3*bH3***b* of each of the magnetic substance blocks 113*b* making up the winding-portion around which the winding is wound. Moreover, each of the magnetic substance blocks 113*a* is formed so as to have the cross-sectional area W3*aH3***a* and, therefore, by reducing the cross-sectional area W3*aH3***a*, the volume of each of the magnetic substance blocks 113*a* can be reduced. As a result, the reduction of the volume of each of the two magnetic substance blocks 113*a* enables the miniaturization and low-costs of the entire core 119.

Incidentally, the broken lines in FIG. 9 show a core shape to be taken when the core (block) width 3Ca of each of the magnetic substance blocks 113*a* is made to be 15.0 mm being the same as the core (block) width of each of the magnetic substance blocks 1113*b*, that is, when the cross-sectional width W3Ca*H3*a* of each of the magnetic substance blocks 113*a* making up the non-winding portion is not made to be smaller than the cross-sectional area W3*bH3***b* of each of the magnetic substance blocks 113*b* making up the winding portion.

The table in FIG. 11 shows a relation among the width 3*a* of the core 119 of each of the magnetic substance blocks 113*a* making up the reactor part which is changed to be 12.5 mm (in the example 10), and 10 mm (in the example 11), three samples No. 1, No. 2, and No. 3 of the reactor configured in a manner shown in FIG. 10, and the inductance value (μH) measured relative to a current value (20 A). Moreover, the case where the core (block) width W3Ca of the magnetic substance blocks 113*a* is 15.0 mm as used in the conventional example is also shown as a comparative example.

As shown in FIG. 11, three samples of the reactor 110 using the core 119 of each of the magnetic substance blocks 113*a* whose width W3*a* is changed to 12.5 mm (example 10) and 10.0 mm (example 11) are prepared and the inductance (μH) of the three samples is measured under conditions of 10 KHz, 1V, and DC 20 (A). As is apparent from FIG. 11, in the tenth embodiment in which the width W3*a* of the core (block) of each of the magnetic substance block 113*a* is made to be 12.5 mm, inductance of all samples including No. 1, No. 2, and No. 3 is the same as those in the comparative example (average inductance value (μH) for the three samples has decreased by 0.4%). Therefore, if the width 3Wa of the core (block) as in the present invention is reduced to 12.5 mm, the same inductance value as in the case where no width is reduced [in the case where the core (block) width W3*c* is 15.0 mm] can be obtained under the conditions as above. Thus, it has been confirmed that, when the core (block) width W3*a* is reduced to 12.5 mm, as in the case where no width is reduced at all, the functions shown in FIG. 10 of the reactor can be performed fully.

The table in FIG. 12 shows a state in which a reactor part is formed having a core 119 whose width Wa of the magnetic substance block 113*a* is changed to be 12.5 mm (example 10) and to be 10.0 mm (example 11) and the reactor is driven using the reactor part in the manner as shown in FIG. 10 to compare the degree of a rise in temperature among the temperature (1) among coils, (2) temperature on the coil surface, (3) temperature on the coil upper face, and (4) ambient temperature shown in FIG. 10. Moreover, the case where the core (block) width W3Ca of the magnetic substance blocks 113*a* is 15.0 mm as used in the conventional example is also shown as a comparative example.

As shown in FIG. 12, in the reactor 110 using the core (block) 119 whose width W3*a* is changed to 12.5 mm (example 10) and 10.0 mm (example 11) of the magnetic substance block 113*a* shown in FIG. 19, a temperature (1) among coils, (2) on the coil surface, (3) on the coil upper face, and (4) ambient temperature shown in FIG. 10 occurring when the reactor is driven under the conditions shown in FIG. 11 and an increment Δt (degree C.) of the temperature rise from the time when no reactor is driven are measured. As is apparent from FIG. 12, in the example 10 in which the width W3*a* of the core (block) of each of the magnetic substance block 113*a* is made to be 12.5 mm, the temperature rise is the same as that in the comparative example (average temperature is larger than that of the comparative example by about 1.4%). Therefore, as in the present embodiment, if the core (block) width 3*a* is reduced to 12.5 mm, under the conditions as above, the same temperature characteristic can be obtained as in the case where width is not reduced at all [the core (block) width W3Ca is 15.0 mm].

Moreover, similarly, the reactor part including the core 119, whose width W3*a* is changed to be 12.5 mm (example 10) and 10.0 mm (example 11), of the magnetic substance blocks 113*a* and noises occurring when the reactor having the reactor part is driven are measured. As a comparative example, noises are measured in the same manner as above when the W3Ca of the core (block) of the magnetic substance blocks 113*a* is made to be 15.0 mm as in the conventional example. FIG. 13 shows the result of measuring noises in the comparative example in which the width 3Ca is made to be 15.0 mm. FIG. 14 shows the result of measuring noises in the example 10 in which the width 3Ca is made to be 12.5 mm. FIG. 15 shows the result of measuring noises in the example 11 when the width 3Ca is made to be 10.0 mm.

As is apparent in FIGS. 13 and 14, there is almost no difference between the example 10 in which the width 3Ca is made to be 12.5 mm and the comparative example in which the width is made to be 15.0 mm. On the contrary, as shown in FIGS. 13 and 15, in the example 10 where the width 3Ca is made to be 10.0 mm, when compared with the case where the width is 15.0 mm, noises become worse, for example, noises increase in a region of frequency of 2 KHz to 6 KHz. The reason for this is thought to be that, in the example 11 where the width is made to be 10.0 mm, reduction of the cross-sectional area causes the magnetic flux to be concentrated and the noises caused by vibration and the force of electromagnetic attraction to increase.

Next, a reactor part of the fourth embodiment will be described. FIGS. 16 to 22 show configurations of the reactor part of the fourth embodiment. FIGS. 23 to 28 show a state of magnetic flux distribution of a corresponding core.

The reactor of the fourth embodiment is characterized in that, as in the first to third embodiments, at least two magnetic substance blocks each having a rectangular and plane shape are arranged in parallel with an interval interposed between one another and two non-winding portions each made up of the approximately trapezoidal or triangular magnetic substance blocks are arranged in a manner in which the magnetic substance blocks making up the winding-portion are sandwiched between bottoms of the approximately trapezoidal or triangular non-winding portions and a cross-sectional area in a direction orthogonal to a magnetic path in the approximately trapezoidal or triangular crest portion of each of the magnetic substance blocks making up the non-winding portion is made smaller than a cross-sectional area in a direction orthogonal to a magnetic path of each of the magnetic substance blocks making up the winding portion. By configuring as above, it is possible to reduce the volume of each of the magnetic substance blocks making up the non-winding portion when compared with the case where the non-winding portion is made up of U-shaped magnetic substance blocks or rectangular magnetic substance blocks. As a result, further miniaturization, light-weight, or low-costs of the reactor part, that is, the core can be achieved.

The essence of the present invention in the fourth embodiment is that, unlike in the conventional case where the design of the magnetic path with the same cross-sectional shape, by reducing portions through which no flux is made to pass, while a DC superimposition characteristic in the high current region is maintained, optimization of the core shape which enables the miniaturization of the reactor is achieved which is based on the same technology idea as employed in the first and third embodiments.

That is, in the example 1 and in the modified examples 1 to 5 of the fourth embodiment, as in the first to third embodiment, by reducing the width of the blocks so as to make the width Wa of each of the two magnetic substance blocks making up the non-winding portion in which no winding 2 (see FIGS. 2 and 3) or 112 (see FIG. 10) is not wound be smaller than the width Wb of each of the magnetic substance blocks 123*b*, the cross-sectional area in the direction orthogonal to the magnetic path in the two magnetic substance blocks 123*a* making up the non-winding portion of the core 129 is made smaller than the cross-sectional area in the direction orthogonal to the magnetic path in the two magnetic substance blocks 123*b* making up the winding-portion. However, in the example 1 and in the modified examples 1 to 5 of the fourth embodiment, unlike the first and second embodiments in which each of the two magnetic substance blocks 123*a* making up the non-winding portion is made up of the U-shaped magnetic substance blocks and unlike the third embodiment in which the blocks are made up of the rectangular magnetic substance blocks, by forming the magnetic substance blocks each having the approximately trapezoidal or triangular shape so as to sandwich the two groups of the magnetic substance blocks 123*b* making up the winding portion between bottoms of the approximately trapezoidal or triangular portions making up the non-winding portion, the cross-sectional area in the direction orthogonal to the magnetic path in the approximately trapezoidal or triangular crest portion of the magnetic substance block 123*a* making up the non-winding portion is made smaller than the cross-sectional area in the direction orthogonal to the magnetic path of the magnetic substance blocks 123*b* making up the winding portion.

By configuring as above, unlike the case in which the non-winding portion is made up of the U-shaped magnetic substance blocks or rectangular magnetic substance blocks, the volume of each of the magnetic substance blocks 123 making up the non-winding portion can be made smaller, even when the length of the entire core 129 remains the same blocks. Therefore, the configurations enables further the miniaturization, light-weight, and low-costs of the reactor part, that is, the reactor.

Moreover, the reactor of the fourth embodiment can be obtained by cutting both corners (round-shaped corner portion) of each of the two U-shaped magnetic substance blocks 103*a* used in the first and second embodiments so as to have a plane shape and, therefore, the reactor of the fourth embodiment can be realized by using the optimum value of the core width of the non-winding portion employed in the first and second embodiments (in other words, by using, as the optimum value, the height of the approximate trapezoid or approximate triangle, that is, the core width in the approximately trapezoidal or triangular crest portion).

The inventor of the present invention, from a viewpoint that, by reducing portions through which no magnetic flux is made to pass, optimization of the reliable core shape is obtained, designs the core of the reactor part in the example 1 shown in FIG. 16 and in the modified examples 1 to 5 obtained by changing the dimension Wm shown in FIG. 16(*a*) and observes a magnetic flux simulation state to obtain the optimum shape of the approximate trapezoid or approximate triangle of each of the magnetic substance block 123*a* making up the non-winding portion. First, configurations of a core of a reactor part of the example 1 of the fourth embodiment will be described. FIG. 16 is a diagram showing a shape of a core of a reactor part according to an example 1 of the fourth embodiment of the present invention. FIG. 16(*a*) is its plan view and FIG. 16(*b*) is its perspective view. The core 129 of the reactor part of the example 1, as shown in FIGS. 16(*a*) and 16(*b*), is divided into eight portions as a whole. The core 129 of the reactor part of the fourth embodiment is made up of two magnetic substance blocks 123*a*, six magnetic substance blocks 123*b*, and a sheet member (not shown) inserted among blocks as a member for a magnetic gap. The non-winding portion includes two magnetic substance blocks 123*a* each having an approximately trapezoidal plane shape. The two non-winding blocks are located to be faced each other in a manner in which the bottoms of the two trapezoidal non-winding blocks sandwich the six magnetic substance blocks 123*b* making up the winding portion with space being interposed between one group of the three blocks 123*b* and another group of the three blocks 123*b* and, therefore, the cross-sectional area in a direction orthogonal to a magnetic path in the approximately trapezoidal crest of each of the magnetic substance blocks 123*a* making up the non-winding portions is made smaller than the cross-sectional area in a direction orthogonal to a magnetic path of each of the magnetic substance blocks 123*b* making up the winding portion. Moreover, the shape of the core 129 of the reactor part is ring-like as a whole, however, four round portions of the ring-like shape are cut so as to be plane in shape and the six magnetic substance blocks 123*b* making up the winding portion described above forms two straight lines each being made up of three magnetic substance blocks 123*b* and the winding 2 is wound around each of the two straight lines with the winding frame of the bobbin 4 being interposed as shown in FIG. 3 and, as a result, specified electrical characteristics can be obtained. Here, dimensions of each of the magnetic substance blocks forming the core 129 of the example 1 of the fourth embodiment are explained. Each of the magnetic substance blocks 123*b*, as shown in FIG. 16(*a*), is so configured to have a core width Wb of 27.0 mm, a block length Lb of 16.5 mm. On the other hand, each of the magnetic substance blocks 123*a*, as shown in FIG. 16(*a*), has a block length La of 72.0 mm, a core (block) length in the approximately trapezoidal crest portion (crest side) of 18.0 mm. Also, both a height Ha of each of the magnetic substance blocks 123*a* and a height Hb of each of the magnetic substance blocks 123*b* have the same dimension of 27.5 mm.

Thus, according to the example 1 of the fourth embodiment, the cross-sectional area Wb*Hb in the direction orthogonal to the magnetic path of each of the magnetic substance blocks 123*b* making up the winding portion around which the winding is wound is 742.5 mm, while the cross-sectional area Wa*Ha of the approximately trapezoidal crest portion (crest side) of each of the magnetic substance blocks 123*a* making up the non-winding portion around which no winding is wound is 495.0 mm. Thus, in the example 1, as in the first to third embodiments, the cross-sectional area in the direction orthogonal to the magnetic path of the non-winding portion of the core is made smaller than the cross-sectional area in the direction orthogonal to the magnetic path of the winding portion. More specifically, as in the example 6 of the first embodiment, the cross-sectional area Wa*Ha of each of the magnetic substance blocks 123*a* making up the non-winding portion around which no winding is wound remains about 67% (about 0.67 times) of the cross-sectional areas Wb*Hb in the direction orthogonal to the magnetic path of each of the magnetic substance blocks 123*b* making up the winding-portion around which the winding is wound. In other words, the cross-sectional area Wa*Ha of each of the magnetic substance blocks 123*a* making up the non-winding portion is made smaller by about 33% than the cross-sectional area Wb*Hb of each of the magnetic substance blocks 123*b* making up the winding portion. Moreover, in the example 1 of the fourth embodiment, as shown in FIGS. 16(*a*) an 16(*b*), each of the magnetic substance blocks 123*a* making up the non-winding portion is so formed as to have the approximately trapezoidal shape and the above cross-sectional area Wa*Ha (495.0 $mm^2$) is a cross-sectional area of the approximately trapezoidal crest portion (crest side) and the cross-sectional area of the crest portion (crest side) is made smaller than the cross-sectional area Wb*Hb (742.5 $mm^2$) in the direction orthogonal to the magnetic path of each of the magnetic substance blocks 123*b* making up the winding portion. Thus, since each of the magnetic substance blocks 123*a* making up the non-winding portion is formed so as to have the approximately trapezoidal shape, the volume of each of the magnetic substance blocks 123*a* is reduced further by about 30% when compared with the example 6 of the first embodiment in which the U-shaped magnetic substance blocks are employed. As a result, great reduction of the volume of each of the magnetic substance blocks 123*a* enables further miniaturization and low-costs of the entire core 129. In FIG. 16(*a*), the core 129 is so configured as to have the dimensional ratio of Wa=Wb×⅔ (about 0.67), Wn=Wa (constant), and Wm=Wb. That is, the core 129 of the example 1 is so formed so that Wm=Wb and so that the dimension Wm serving as a parameter is set as Wm=Wb×1 which is equal to Wb being a core width of each of the magnetic substance blocks 123*b* making up the winding portion.

Here, comparison is made between the example 6 of the first embodiment using the U-shaped magnetic substance block and the example 1 of the fourth embodiment. In the core 129 of the reactor part of the example 1 of the fourth embodiment, portions through which almost no magnetic flux is made to pass are reduced and, therefore, the cross-sectional area in the direction of the magnetic path in the crest portion of the two magnetic substance blocks 123*a* making up the non-winding portion where no winding is wound is made smaller than the cross-sectional area in the direction orthogonal to the magnetic path of the two magnetic substance blocks 123*b* making up the winding portion, which is the same as in the core of the reactor part of the example 6 of the first embodiment. Moreover, in the example 6 of the first embodiment, both the corner portions of the two magnetic substance blocks 103*a* are formed to be of a round-shape, while, in the example 1 of the fourth embodiment, the round portions of the two magnetic substance blocks 103*a* are cut to become plane and to reduce the volume of the core 129. That is, in the example 6 of the first embodiment, it has been confirmed that both the round-shaped corner portions are the portions around which almost no magnetic flux is made to pass and, therefore, a core shape is discovered which can be obtained by cutting the round portions at both the corners of the blocks to become plane to reduce the corner portions and, as a result, the magnetic substance blocks 123*a* making up the non-winding portion are made to become approximately trapezoidal.

FIG. 17(*a*) is a diagram showing a state of magnetic flux distribution of a core of the reactor part of the example 6 of the first embodiment obtained by simulation. FIG. 17(*b*) is a diagram showing a state of magnetic flux distribution of the core of the reactor part of the example 1 of the fourth embodiment obtained by simulation. As shown in FIG. 17(*a*), it can be confirmed that both the round-shaped corner portions of the two magnetic substance blocks 103*a* are portions around which almost no magnetic flux is made to pass. As shown in FIG. 17(*b*), by forming each of the magnetic substance blocks 123*a* making up the non-winding portion by using magnetic substance blocks each having the approximately trapezoidal and plane shape, the same state occurs where both the round-shaped corner portions are cut to have the plane shape to reduce the portions, which means that portions through which almost no magnetic flux is made to pass are further reduced and the volume corresponding to portions cut in each of the two magnetic substance blocks 123*a* can be reduced. This enables further more miniaturization, light-weight, and low-costs of the core 129 of the reactor part when compared with the example 6 in the first embodiment.

As described above, the present inventor designed a core of the reactor parts of modified examples 1 to 5 obtained by changing the dimension Wm shown in FIG. 16(*a*), in addition to the example 1, observed the magnetic flux distribution state by simulation, and found out the optimum shape in the approximate trapezoid or approximate triangle for each of the magnetic substance blocks 123*a* making up the non-winding portion. Hereinafter, configurations of the core of the reactor part according to these modified examples 1 to 5 are described.

First, the core of the reactor part of the modified example 1 is described. The core of the reactor part of the modified example 1 is the same as in the example 1 of the first embodiment described above in that the winding portion is made up of six magnetic substance blocks each having a rectangular and plane shape and arranged in parallel and the non-winding portion is made up of the two magnetic substance blocks, each being faced each other, having the approximately trapezoidal and plane shape which sandwich the magnetic substance blocks making up the winding portion between bottoms of the non-winding portion and the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion, however, the trapezoidal shape of each of the magnetic substance blocks making up the non-winding portion is different from the shape employed in the example 1 of the first embodiment.

That is, in the modified example 1 of the fourth embodiment, as shown in FIGS. 18(*a*) and 18(*b*), the dimension of the crest portion of each of the two magnetic substance blocks 123*a* is made to be larger than that in the example 1. More specifically, in FIG. 18(*a*), the core 129 is so configured as to have the dimensional ratio of Wa=Wb×⅔ (about 0.67), Wn=Wa (constant), and Wm=Wb×0. That is, the core 129 of the modified example 1 is so formed so that Wm=Wb×0.25 and so that the dimension Wm serving as a parameter is set as ¼ of the Wb being the core width of each of the magnetic substance blocks 123*b* making up the winding portion.

Thus, in the core 129 of the reactor part of the modified example 1, the cross-sectional area in the direction orthogonal to the magnetic path in the crest portion of each of the two magnetic substance blocks 123*a* making up the non-winding portion around which no winding is wound is made smaller than the cross-sectional area orthogonal to the magnetic path of each of the two magnetic substance blocks 123*b* making up the winding portion. Moreover, in the example 1 of the first embodiment, both the corner portions of the two magnetic substance blocks 103 are so formed as to have a round-shape, while, in the modified example 1, the round portions are cut to have a plane. Since each of the two magnetic substance blocks 123*a* is further cut, the volume corresponding to the cut portion can be reduced. As a result, great reduction of the volume of each of the magnetic substance blocks 123*a* enables further miniaturization, light-weight, and low-costs of the entire core 129 as compared with the example 6 of the first embodiment.

Next, the core of the reactor part of the modified example 1 is described. The core of the reactor part of the modified example 2 is the same as in the example 1 of the first embodiment described above in that the winding portion is made up of six magnetic substance blocks each having a rectangular and plane shape and arranged in parallel and the non-winding portion is made up of the two magnetic substance blocks, each being faced each other, having the approximately trapezoidal and plane shape which sandwich the magnetic substance blocks making up the winding portion between bottoms of the non-winding portion and the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion, however, the trapezoidal shape of each of the magnetic substance blocks making up the non-winding portion is different from the shape employed in the example 1 of the first embodiment and the modified example 1.

That is, in the modified example 2 of the fourth embodiment, as shown in FIGS. 19(*a*) and 19(*b*), the dimension of the crest portion of each of the two magnetic substance blocks 123*a* is made larger than that in the example 1, however, smaller than that of the modified example 1. More specifically, in FIG. 19(*a*), the core 129 is so configured as to have the dimensional ratio of Wa=Wb×⅔ (about 0.67), Wn=Wa (constant), and Wm=Wb×0.5. That is, the core 129 of the modified example 1 is so formed so that Wm=Wb×0.5 and so that the dimension Wm serving as a parameter is set as ½ of the Wb being the core width of each of the magnetic substance blocks 123*b* making up the winding portion.

Thus, in the core 129 of the reactor part of the modified example 2, the cross-sectional area in the direction orthogonal to the magnetic path in the crest portion of each of the two magnetic substance blocks 123*a* making up the non-winding portion around which no winding is wound is made smaller than the cross-sectional area orthogonal to the magnetic path of each of the two magnetic substance blocks 123*b* making up the winding portion. Moreover, in the example 6 of the first embodiment, both the corner portions of the two magnetic substance blocks 103*a* are so formed as to have a round-shape, while, in the modified example 2, the round portions are cut to have a plane. Since each of the two magnetic substance blocks 123*a* is further cut, the volume corresponding to the cut portion can be reduced. As a result, great reduction of the volume of each of the magnetic substance blocks 123*a* enables further miniaturization, light-weight, and low-costs of the entire core 129 as compared with the example 6 of the first embodiment.

Next, the core of the reactor part of the modified example 3 is described. The core of the reactor part of the modified example 3 is the same as in the example 1 of the first embodiment described above in that the winding portion is made up of six magnetic substance blocks each having a rectangular and plane shape and arranged in parallel and the non-winding portion is made up of the two magnetic substance blocks, each being faced each other, having the approximately trapezoidal and plane shape which sandwich the magnetic substance blocks making up the winding portion between bottoms of the non-winding portion and the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion, however, the trapezoidal shape of each of the magnetic substance blocks making up the non-winding portion is different from the shape employed in the example 1 of the first embodiment and the modified example 1 of the fourth embodiment.

That is, in the modified example 3 of the fourth embodiment, as shown in FIGS. 20(*a*) and 20(*b*), the dimension of the crest portion of each of the two magnetic substance blocks 123*a* is made larger than that in the example 1, however, smaller than that of the modified example 2. More specifically, in FIG. 20(*a*), the core 129 is so configured as to have the dimensional ratio of Wa=Wb×⅔ (about 0.67), Wn=Wa (constant), and Wm=Wb×0.75. That is, the core 129 of the modified example 1 is so formed so that Wm=Wb×0.75 and so that the dimension Wm serving as a parameter is set as ¾ of the Wb being the core width of each of the magnetic substance blocks 123*b* making up the winding portion.

Thus, the core 129 of the reactor part of the modified example 3 is the same as in the example 6 of the first embodiment described above in that the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion and, moreover, in the example 6 of the first embodiment, both the corner portions of the two magnetic substance blocks 103*a* is so formed as to have a round-shape, while, in the modified example 2 of the fourth embodiment, the round portions are cut to have a plane. Since each of the two magnetic substance blocks 123*a* is further cut, the volume corresponding to the cut portions can be reduced accordingly. As a result, also in the modified example 2, great reduction of the volume of each of the magnetic substance blocks 123*a* enables further miniaturization, light-weight, and low-costs of the entire core 129 when compared with the example 6 of the first embodiment.

Next, a core of the reactor part of the modified example 4 of the fourth embodiment is described. The core of the reactor part of the modified example 4 is the same as in the example 1 of the first embodiment described above in that the winding portion is made up of six magnetic substance blocks each having a rectangular and plane shape and arranged in parallel and the non-winding portion is made up of the two magnetic substance blocks, each being faced each other, having the approximately trapezoidal and plane shape which sandwich the magnetic substance blocks making up the winding portion between bottoms of the non-winding portion and the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion, however, the trapezoidal shape of each of the magnetic substance blocks making up the non-winding portion is different from the shape employed in the example 1 and the modified examples 1 to 3.

That is, in the modified example 4 of the fourth embodiment, as shown in FIGS. 21(*a*) and 21(*b*), the dimension of the crest portion of each of the two magnetic substance blocks 123*a* is made larger than that in the example 1. More specifically, in FIG. 21(*a*), the core 129 is so configured as to have the dimensional ratio of Wa=Wb×⅔ (about 0.67), Wn=Wa (constant), and Wm=Wb×1.25. That is, the core 129 of the modified example 4 is so formed so that Wm=Wb×1.25 and so that the dimension Wm serving as a parameter is set as 5/4 of the Wb being the core width of each of the magnetic substance blocks 123*b* making up the winding portion.

Thus, the core 129 of the reactor part of the modified example 4 of the fourth embodiment is the same as in the example 6 of the first embodiment described above in that the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion and, moreover, in the example 6 of the first embodiment, both the corner portions of the two magnetic substance blocks 103*a* are so formed as to have a round-shape, while, in the modified example 4 of the fourth embodiment, the round portions are cut to have a plane. Since each of the two magnetic substance blocks 123*a* is further cut, the volume corresponding to the cut portions can be reduced. As a result, also in the modified example 4, great reduction of the volume of each of the magnetic substance blocks 123*a* enables further miniaturization, light-weight, and low-costs of the entire core 129 when compared with the example 6 of the first embodiment.

Moreover, a core of the reactor part of the modified example 5 of the fourth embodiment is described. The core of the reactor part of the modified example 5 is the same as in the example 1 and modified examples 1 to 4 in that the winding portion is made up of six magnetic substance blocks each having a rectangular and plane shape and arranged in parallel and the non-winding portion is made up of the two magnetic substance blocks, each being faced each other, having the approximately trapezoidal and plane shape which sandwich the magnetic substance blocks making up the winding portion between bottoms of the non-winding portion and the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion, however, the shape of each of the magnetic substance blocks making up the non-winding portion is different from the shape employed in the example 1 and the modified examples 1 to 4, that is, in the modified example 5, the shape is triangular.

Incidentally, in the modified example 5 of the fourth embodiment, as shown in FIGS. 22(*a*) and 22(*b*), a crest portion of each of the two magnetic substance blocks 123*a* forms a top of a triangle. More specifically, in FIG. 22(*a*), the core 129 is so configured as to have the dimensional ratio of Wa=Wb×⅔ (about 0.67), Wn=Wa (constant), and Wm=Wb×1.425. That is, the core 129 of the modified example 5 is so formed so that Wm=Wb×1.425 and so that the dimension Wm serving as a parameter is set as 57/40 of the Wb being the core width of each of the magnetic substance blocks 123*b* making up the winding portion.

Thus, the core 129 of the reactor part of the modified example 5 of the fourth embodiment is the same as in the example 6 of the first embodiment described above in that the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion and, moreover, in the example 6 of the first embodiment, both the corner portions of the two magnetic substance blocks 103*a* are so formed as to have a round-shape, while, in the modified example 5 of the fourth embodiment, the round portions are cut to have a plane on the two sides except a base of a triangle. Since each of the two magnetic substance blocks 123*a* is further cut, the volume corresponding to the cut portions can be reduced. As a result, also in the modified example 5, great reduction of the volume of each of the magnetic substance blocks 123*a* enables further miniaturization, light-weight, and low-costs of the entire core 129 when compared with the example 6 of the first embodiment. Moreover, as described above, the core 129 of the reactor part of the modified example 5 of the fourth embodiment is configured so that Wm=Wb×1.425 and the ratio between the Wm and Wb is only the example, that is, when a coil width or a like is changed, the value (core shape) of 1.425 is also changed.

In the example 1 and modified examples 1 to 5 of the fourth embodiment, a volume amount of the reduction in the example 1, modified examples 4 and 5 of the fourth embodiment is comparatively larger than an amount of the reduction of the example 6 of the first embodiment. Thus, according to the example 1 and the modified examples 4 and 5, the volume of the two magnetic substance blocks 123*a* can be greatly reduced, which provides an advantage in terms of achieving further miniaturization and low-costs.

On the other hand, FIGS. 23 to 28 are diagrams showing states of magnetic flux distribution of the cores of the reactor parts designed in the example 1 and modified examples 1 to 5 in which the dimension Wm serving as a parameter is changed as described above obtained by simulation on the magnetic flux distribution of each of the cores.

In FIGS. 23 to 28, the dimension Wm of the magnetic substance block 123*a* is changed from the state in which Wm=Wb×1 (example 1) to Wm=Wb×0.25 (modified example 1), Wm=Wb×0.05 (modified example 2), Wm=Wb×0.75 (modified example 3), Wm=Wb×1.25 (modified example 4), and Wm=Wb×1.425 (modified example 5) and the state of magnetic flux distribution of each of the cores 129 of the reactor part is shown by color-coding at a time of operations at its rating Particularly, as is apparent from FIG. 23, in the core of the example 1, the best-balanced state of magnetic distribution without magnetic saturation is shown. Moreover, even in the core of the modified examples 1 to 5, as is apparent from FIGS. 24 to 28, there is found no portion where the magnetic saturation reaches its limit and it can be confirmed that the magnetic distribution state fully being able to be used is indicated.

As described above, in the core of the fourth embodiment of the present invention, the non-winding portion is made up of the two approximately trapezoidal or triangular and plane magnetic substance blocks 123*a*, each being faced each other, having the approximately trapezoidal and plane shape which sandwich the magnetic substance blocks 123*b* making up the winding portion between bottoms of the approximately trapezoidal or triangular non-winding portion and the cross-sectional area in the direction orthogonal to the magnetic path in the trapezoidal crest portions of the magnetic substance blocks making up the non-winding portion is made smaller than the cross-sectional area in the direction orthogonal to the magnetic path of each of the magnetic substance blocks making up the winding portion and, therefore, portions through which almost no flux is made to pass are further reduced thus enabling further low-costs, miniaturization, and light-weight.

Incidentally, according to the fourth embodiment, in the case of using a dust core, its manufacturing is easy because all that has to be done is to fabricate an approximately trapezoidal or triangular mold to pour the dust therein and to heat the mold. Thus, the dust core is highly effective in reducing costs. However, it is needless to say that not only the dust core but also lamination cure are highly effective in reducing costs.

Moreover, the core of the fourth embodiment of the present invention can be housed in the same thermal conductive case 1 as shown in FIG. 2. In the core of the reactor part of the fourth embodiment of the present invention, the non-winding portion is made up of the approximately trapezoidal or triangular and plane magnetic substance blocks and, therefore, there are no round-like corners as in the case of the U-shaped core, which causes an increase of surfaces to be pressed by the thermal conductive case 1, thereby enhancing thermal radiation property. Moreover, since the corner portion of the core of the reactor part is made up of not a round-like corner as in the U-typed core but a plane and, therefore, dead space is reduced which enhances space efficiency.

Incidentally, the cores in the above first, second, and fourth embodiments are so configured as to be of an eight-divided type with a magnetic gap interposed among blocks and the core in the third embodiment is so configured as to be of a four-divided type, however, the present invention can be applied to a non-divided integrated-type core. Moreover, it is needless to say that the present invention can be applied not only to the conventional six-divided type core or a like but also to a divided-type core having the number of division other than four or eight. However, it can be judged from the result from the measurement of an inductance value in the first and third embodiments that, the larger the number of the division is, the larger the amount of reduction of the cross-sectional area in the direction orthogonal to the magnetic path of the non-winding portion of the core becomes.

It is apparent that the present invention is not limited to the above embodiments but may be changed and modified without departing from the scope and spirit of the invention.

INDUSTRIAL APPLICABILITY

The present invention can be widely applied to any core of a reactor part so long as the core has a winding and magnetic substance block which includes a winding-portion around which the winding is wound and a winding-portion around which no winding is wound where the winding is wound around the winding portion.

BRIEF DESCRIPTION OF DRAWINGS

FIG. 5 is a diagram showing a table providing a listing of measuring results of changed width values of the core (block) of the reactor part of the rector of the first embodiment of the present invention and its inductance values (μH) measured relative to each current (A).

FIG. 7 is a diagram showing a table providing a listing of measuring results of changed width values of the core (block) of the reactor part of the rector of the second embodiment of the present invention and its inductance values (μH) measured relative to each current (A).

FIG. 11 is a diagram showing a table providing a listing of measuring results of changed width values of the core (block) of the reactor part of the rector of the second embodiment of the present invention and its inductance values (μH) measured relative to each current (A).

FIG. 12 is a diagram showing a table providing a listing of a temperature rise occurring (1) between coils, (2) on a coil surface, (3) on a reactor surface, and (4) in ambient temperature obtained when a reactor whose core (block) width of its reactor part of the third embodiment of the present invention is driven.

Figure 1:
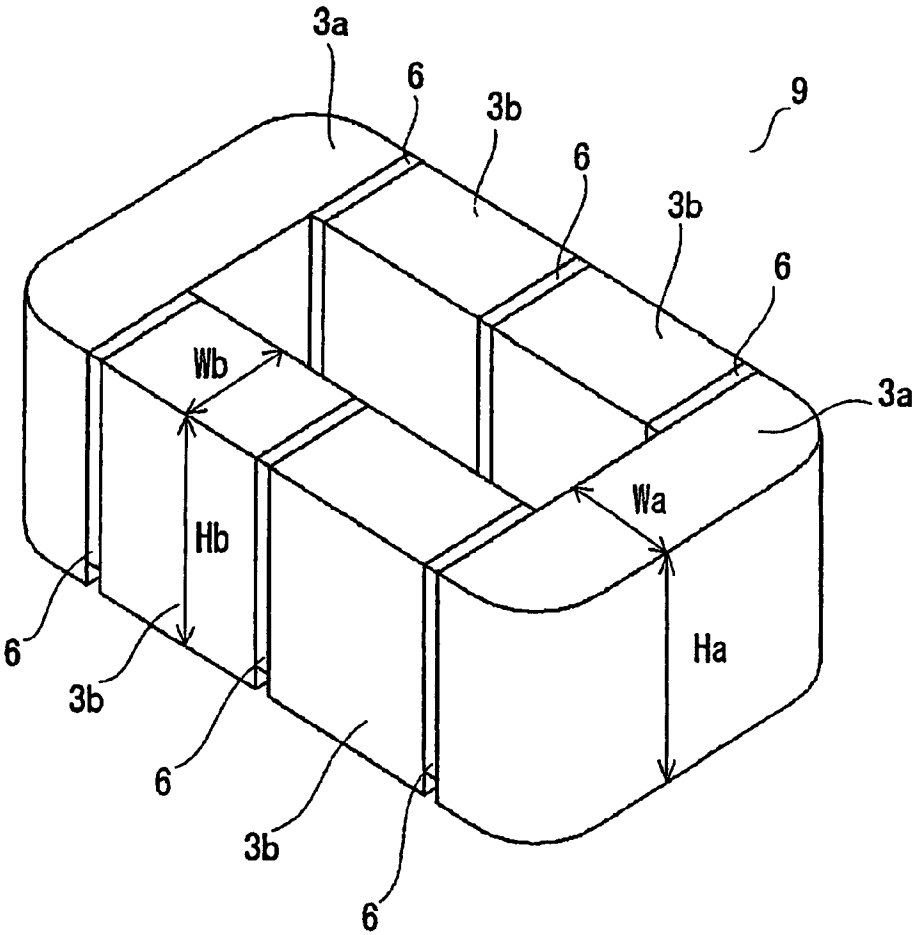
FIG. 1 is a perspective view of a core of a conventional reactor part.
Figure 2:
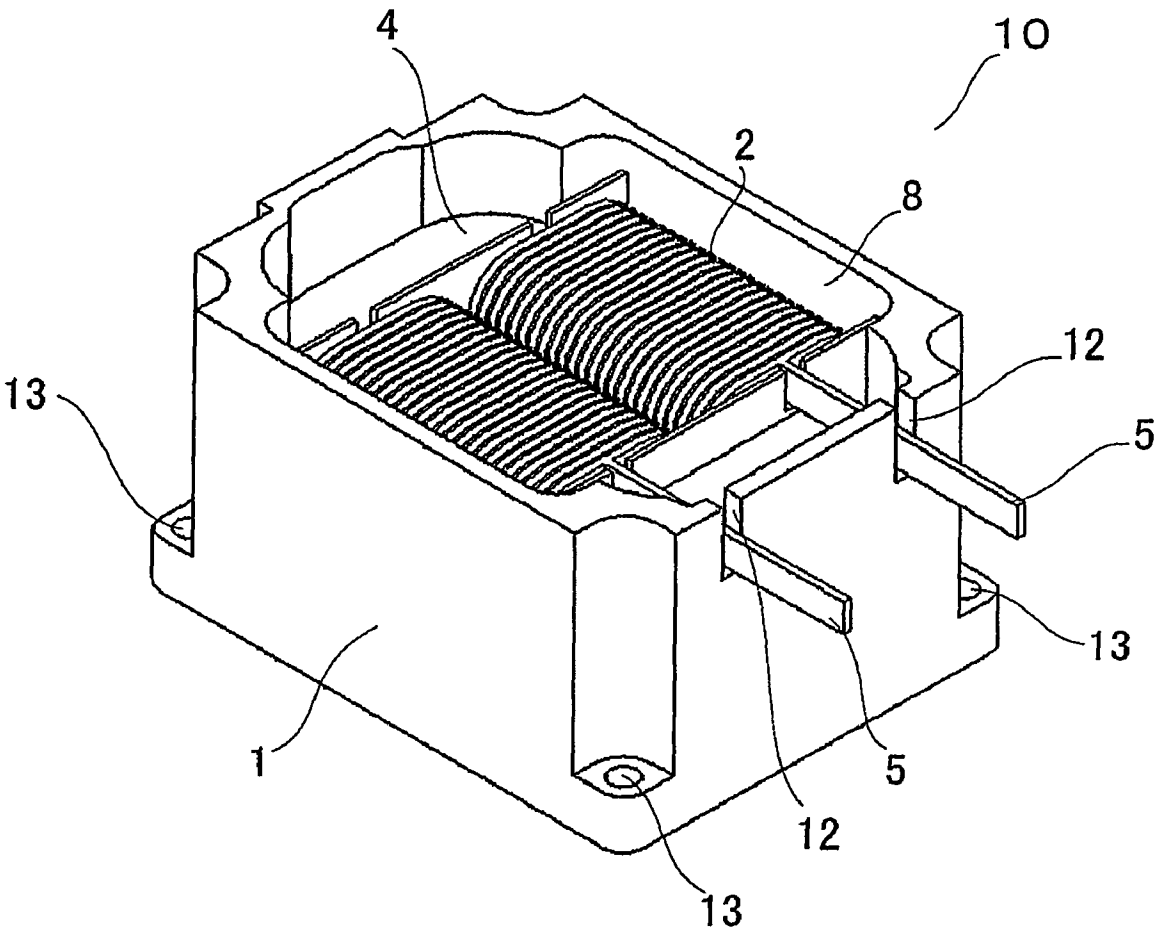
FIG. 2 is a perspective view showing one example of a reactor using a core of a reactor part according to a first embodiment of the present invention.
Figure 3:
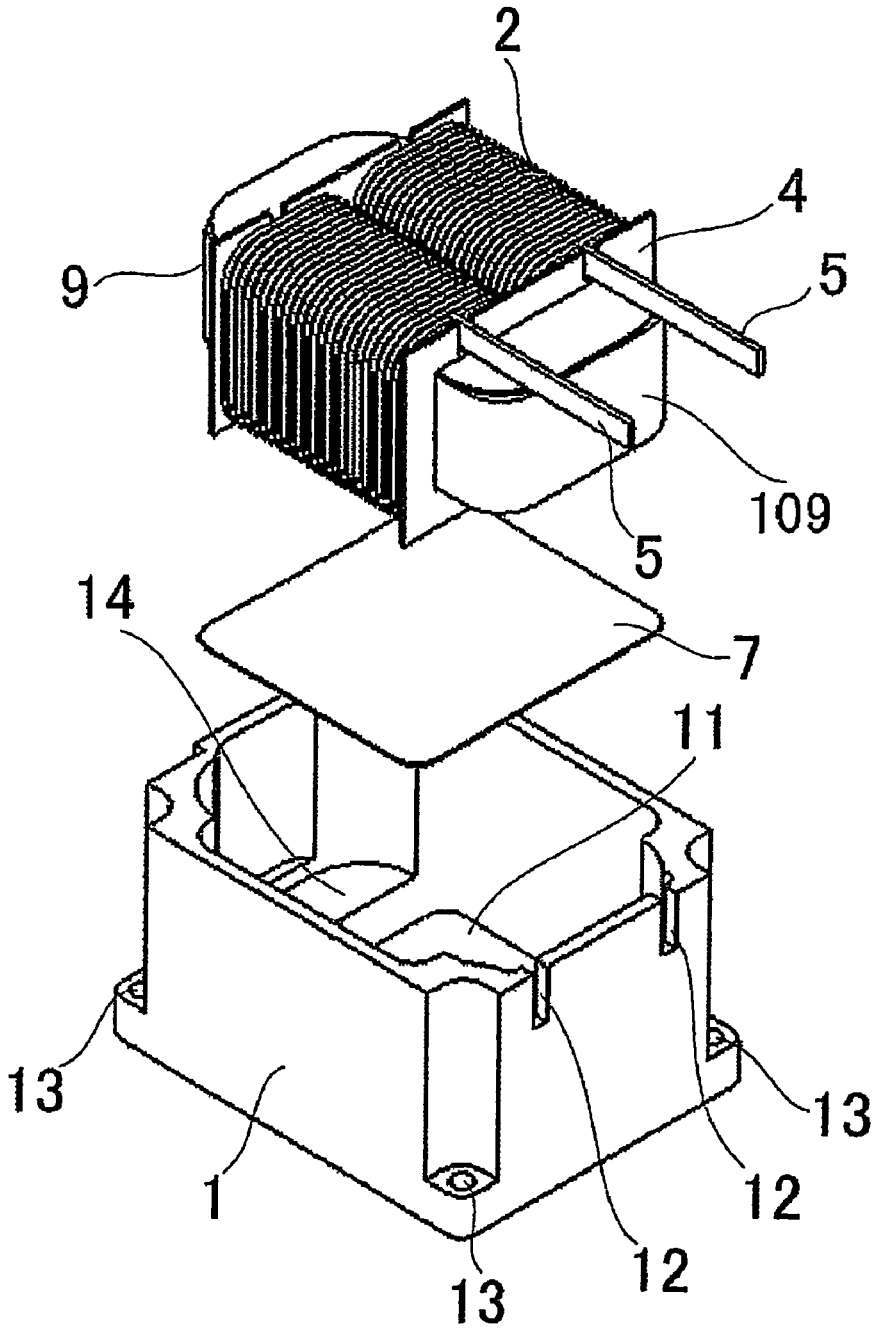
FIG. 3 is an exploded perspective view of the reactor shown in FIG. 2.
Figure 4:
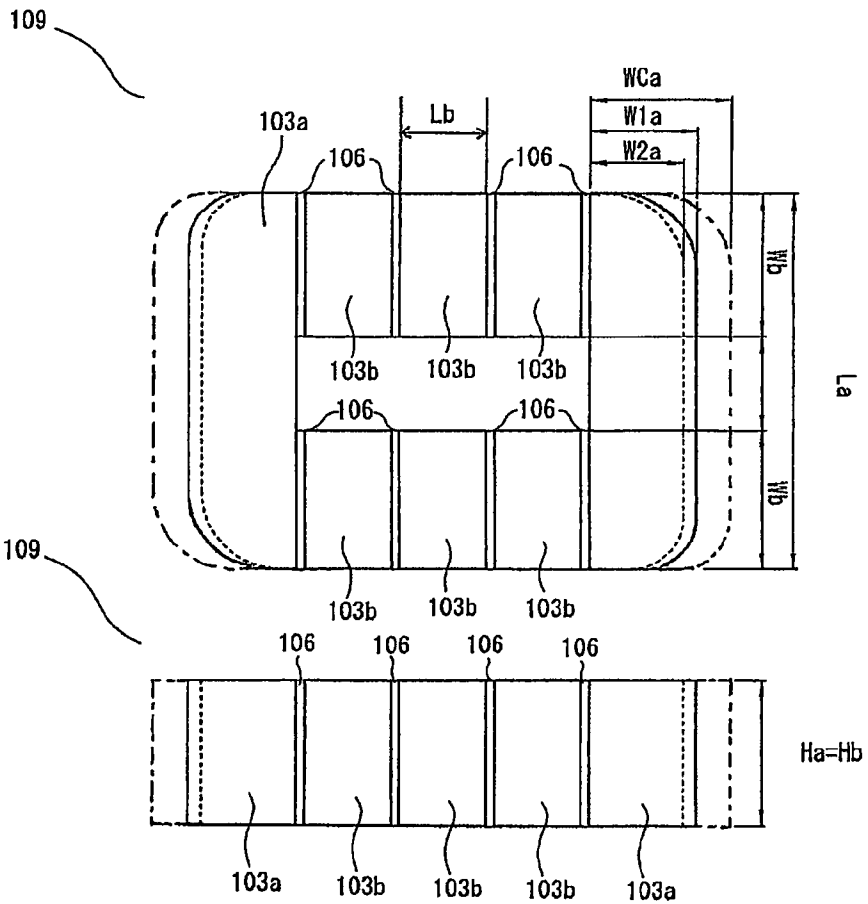
FIG. 4 is a diagram showing a shape of the core of the reactor part according to the first embodiment of the present invention and FIG. 1(*a*) is its plan view and 1(*b*) is its side view.
Figure 6:
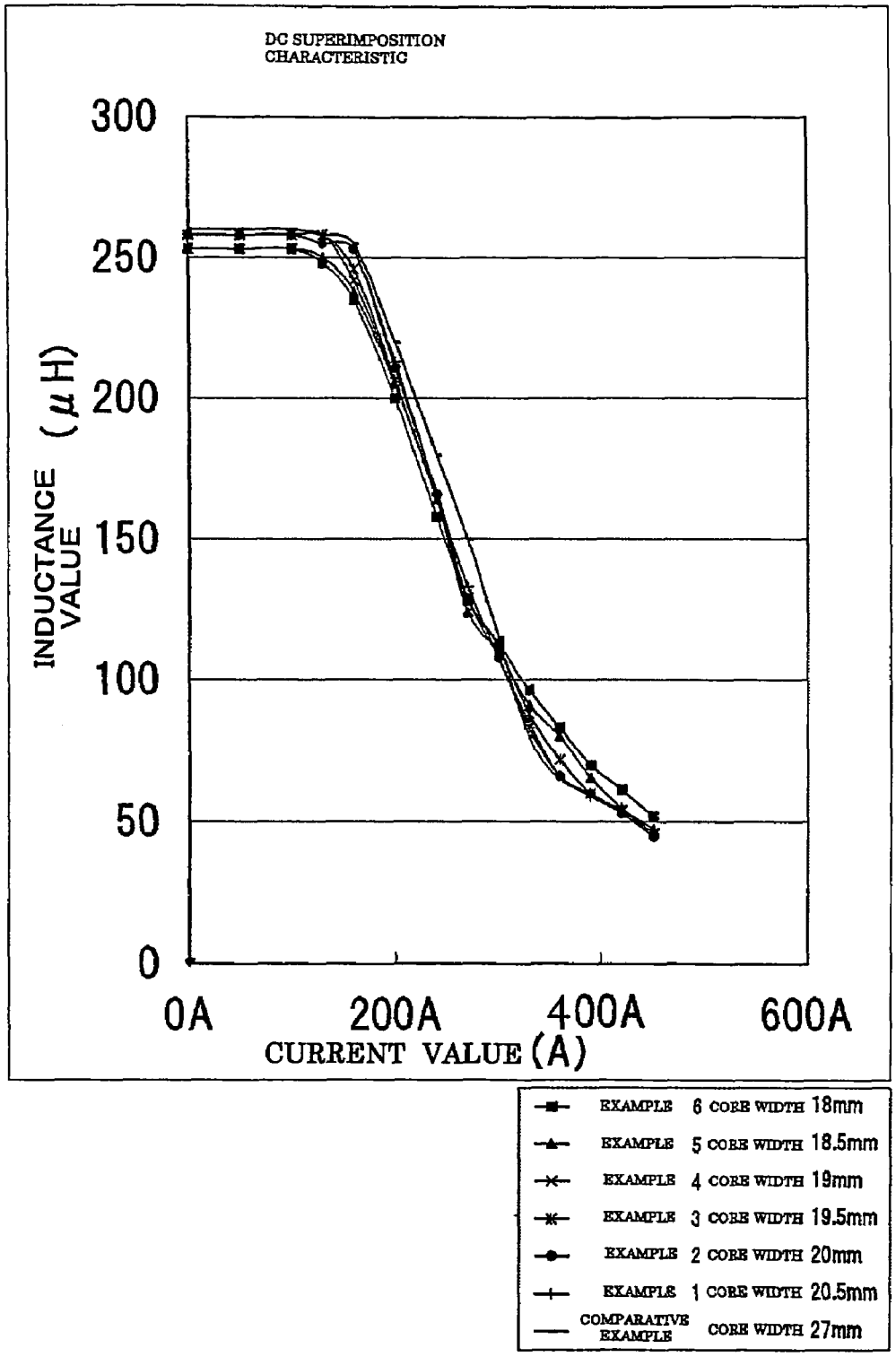
FIG. 6 is a graph showing measurement results shown in FIG. 5.
Figure 8:
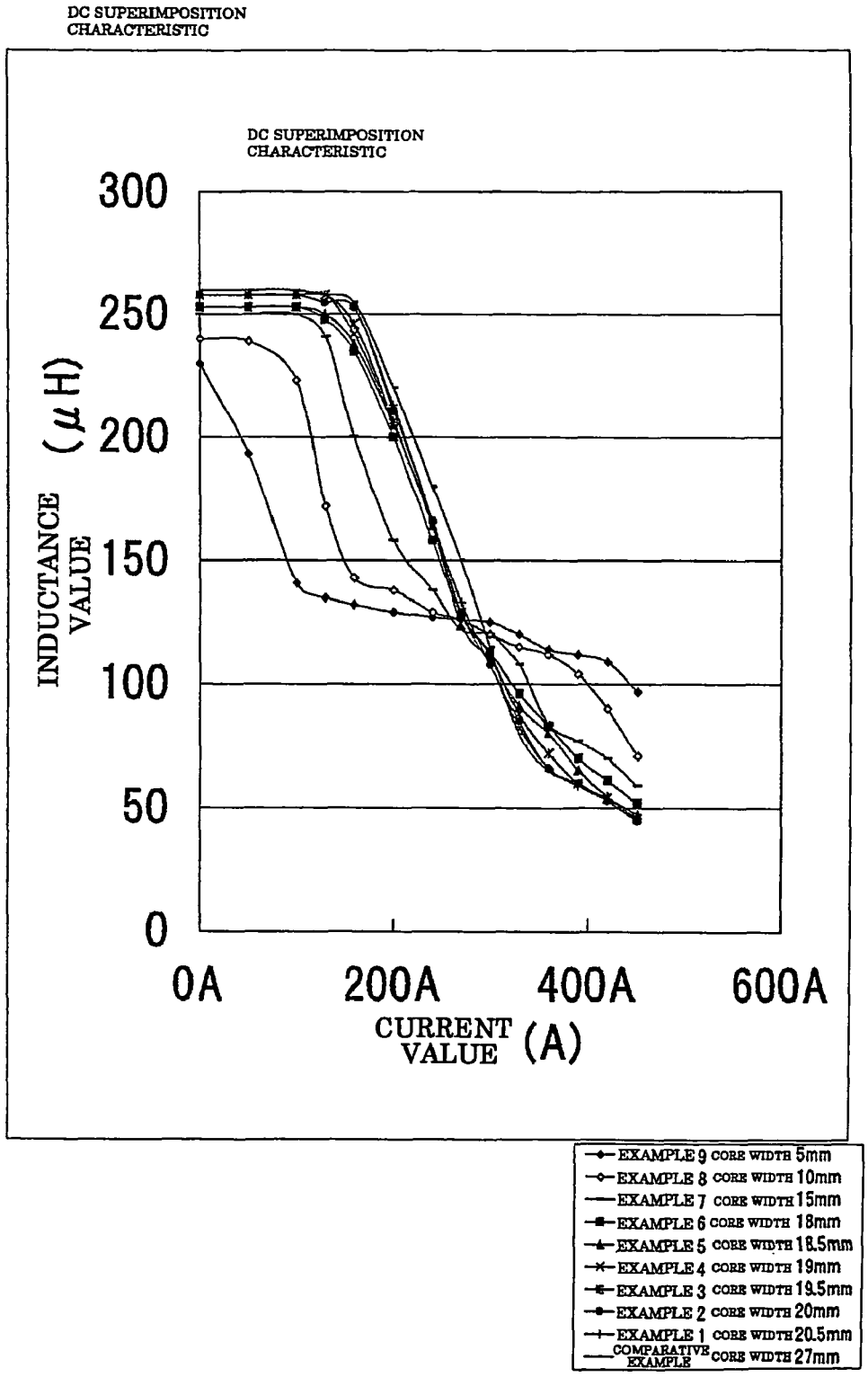
FIG. 8 is a graph showing measurement results shown in FIG. 6.
Figure 9:
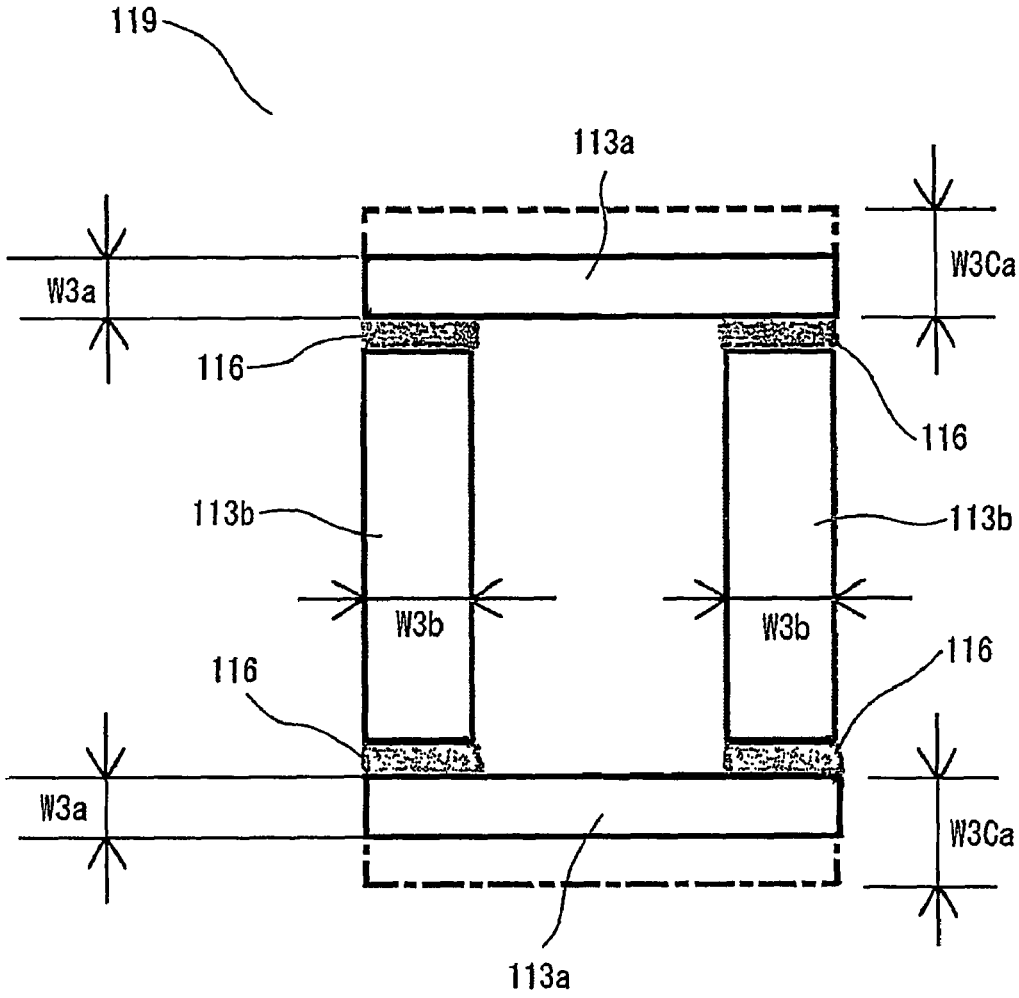
FIG. 9 is a plan view showing a shape of a core of a reactor part according to the third embodiment of the present invention.
Figure 10:
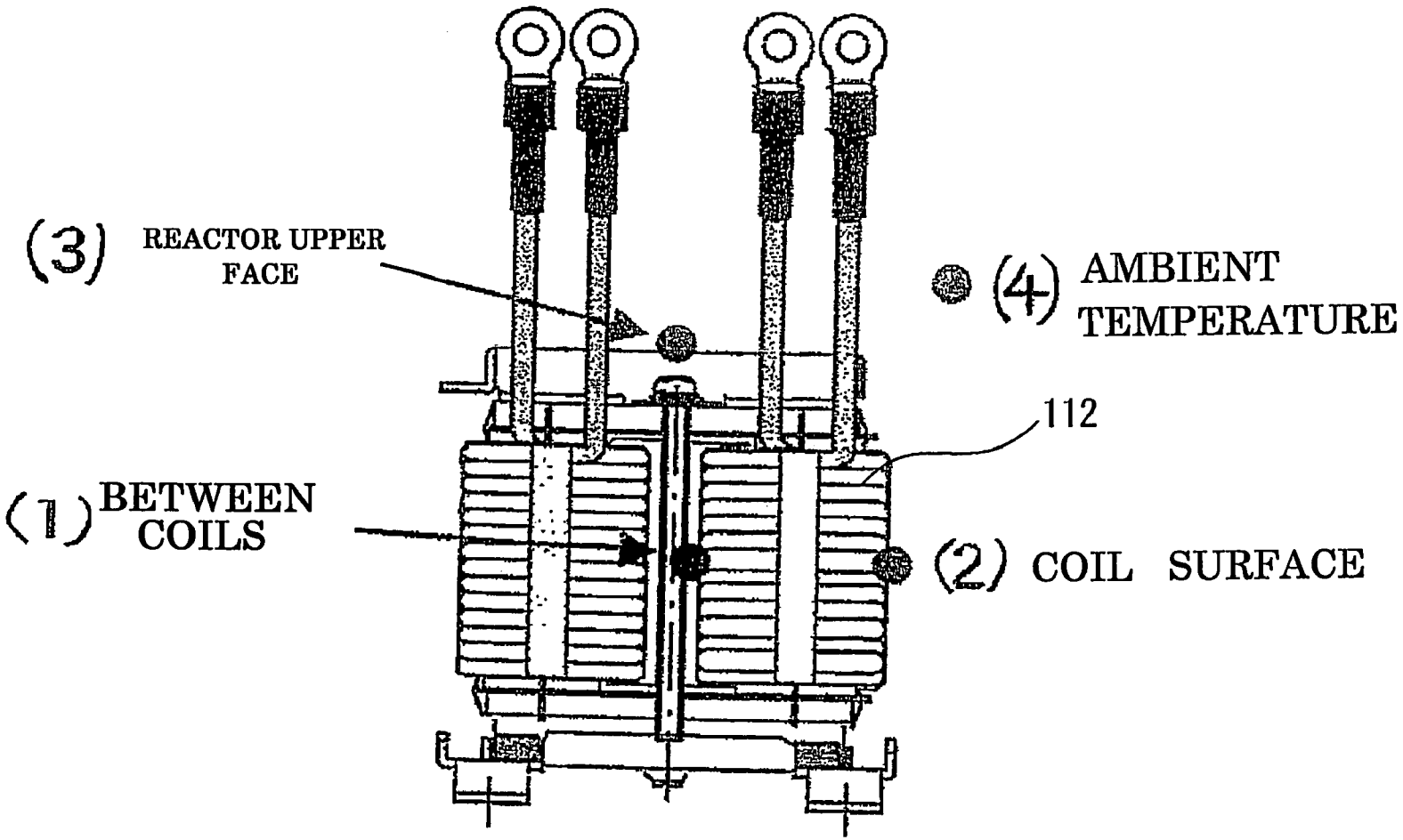
FIG. 10 is a diagram showing the reactor containing the core shown in FIG. 9.
Figure 13:
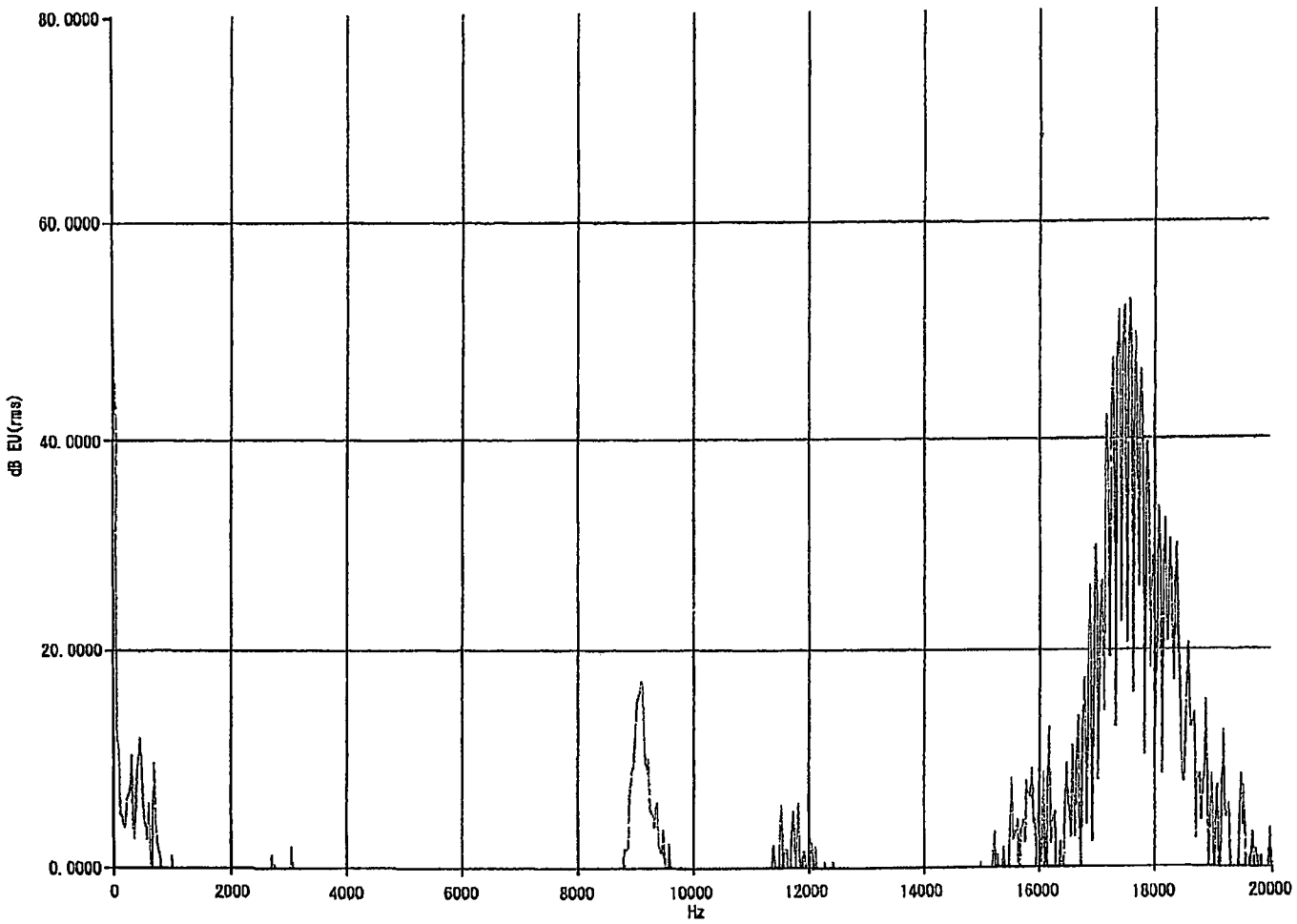
FIG. 13 is a diagram showing measurement results of noises occurring when a reactor whose core (block) width is set at 15.0 mm of an example of the third embodiment is driven.
Figure 14:
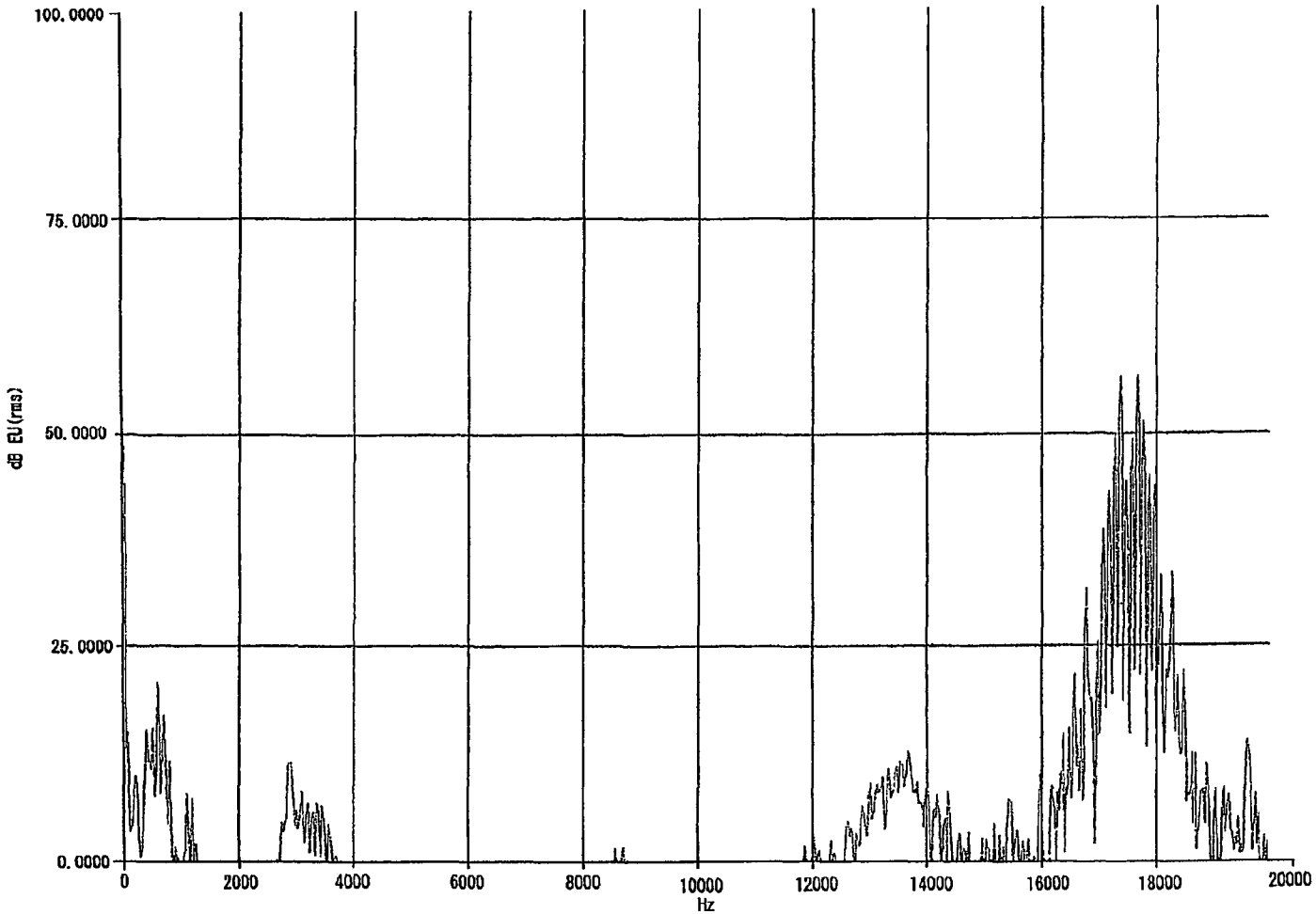
FIG. 14 is a diagram showing measurement results of noises occurring when a reactor whose core (block) width is set at 12.05 mm of an example of the third embodiment is driven.
Figure 15:
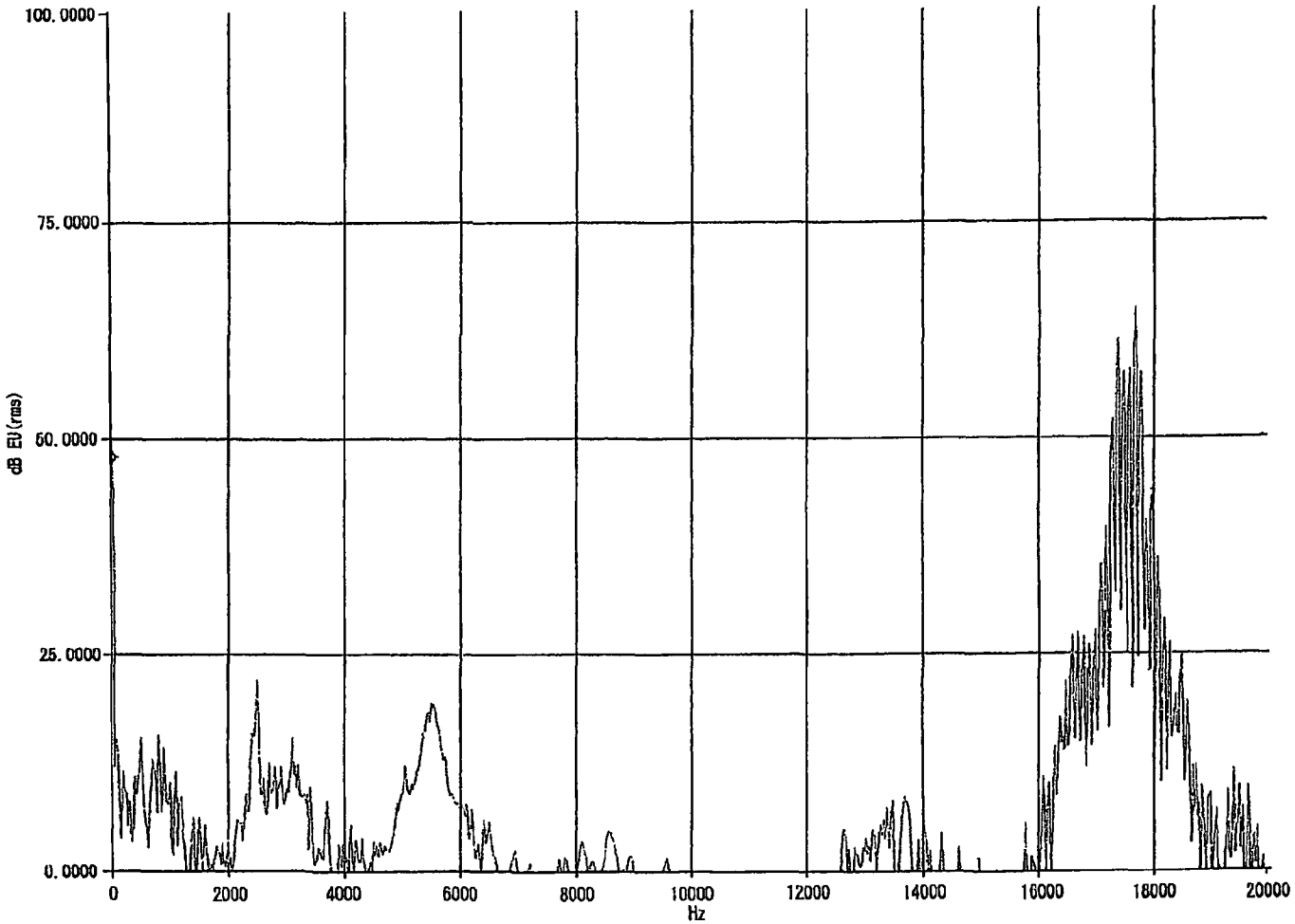
FIG. 15 is a diagram showing measurement results of noises occurring when a reactor whose core (block) width is set at 10.0 mm of an example of the third embodiment is driven.
Figure 16:
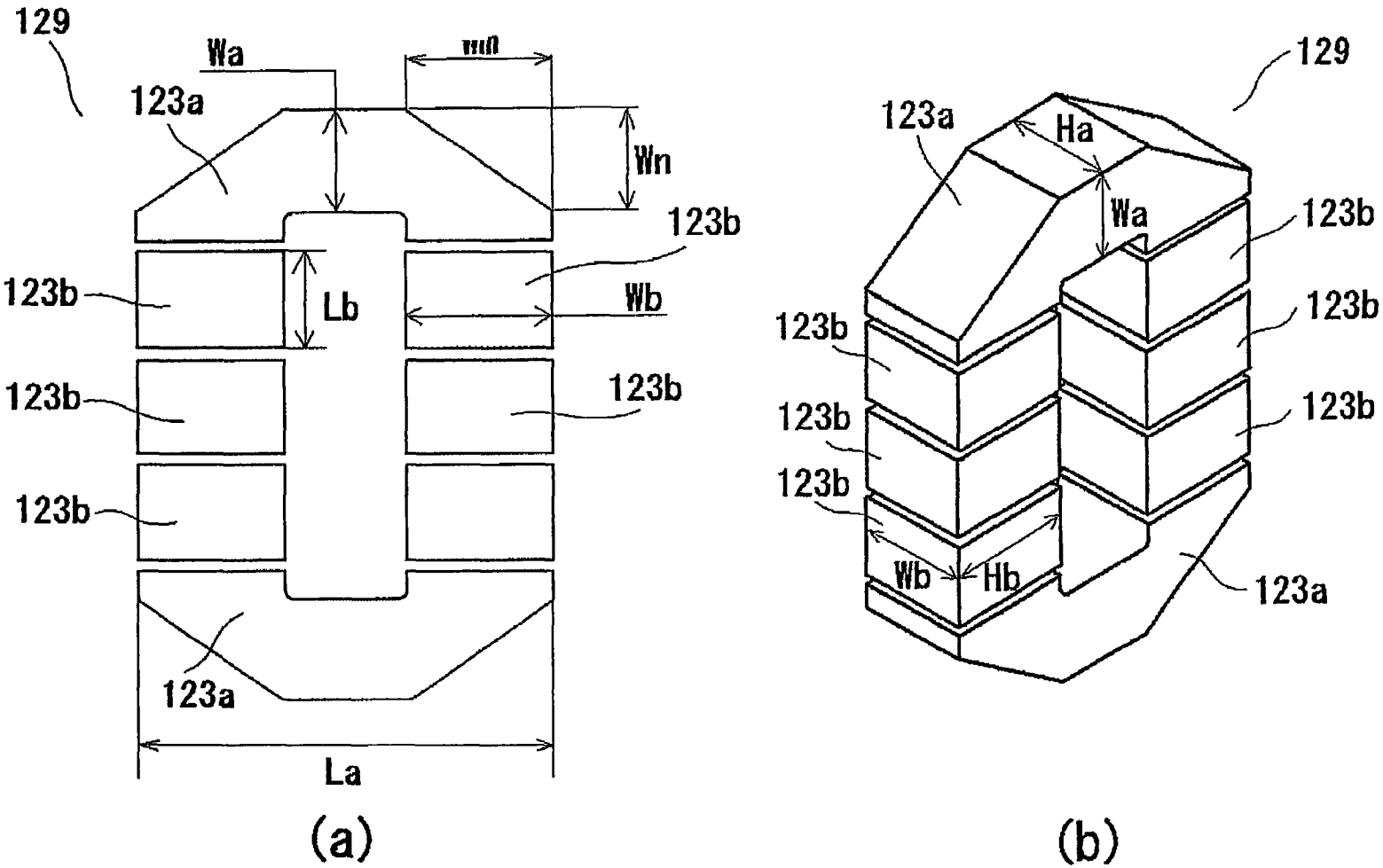
FIG. 16 is a diagram showing a shape of a core of a reactor part of the fourth embodiment of the present invention and FIG. 16(*a*) is its plan view and FIG. 16(*b*) is its perspective view.
Figure 17:
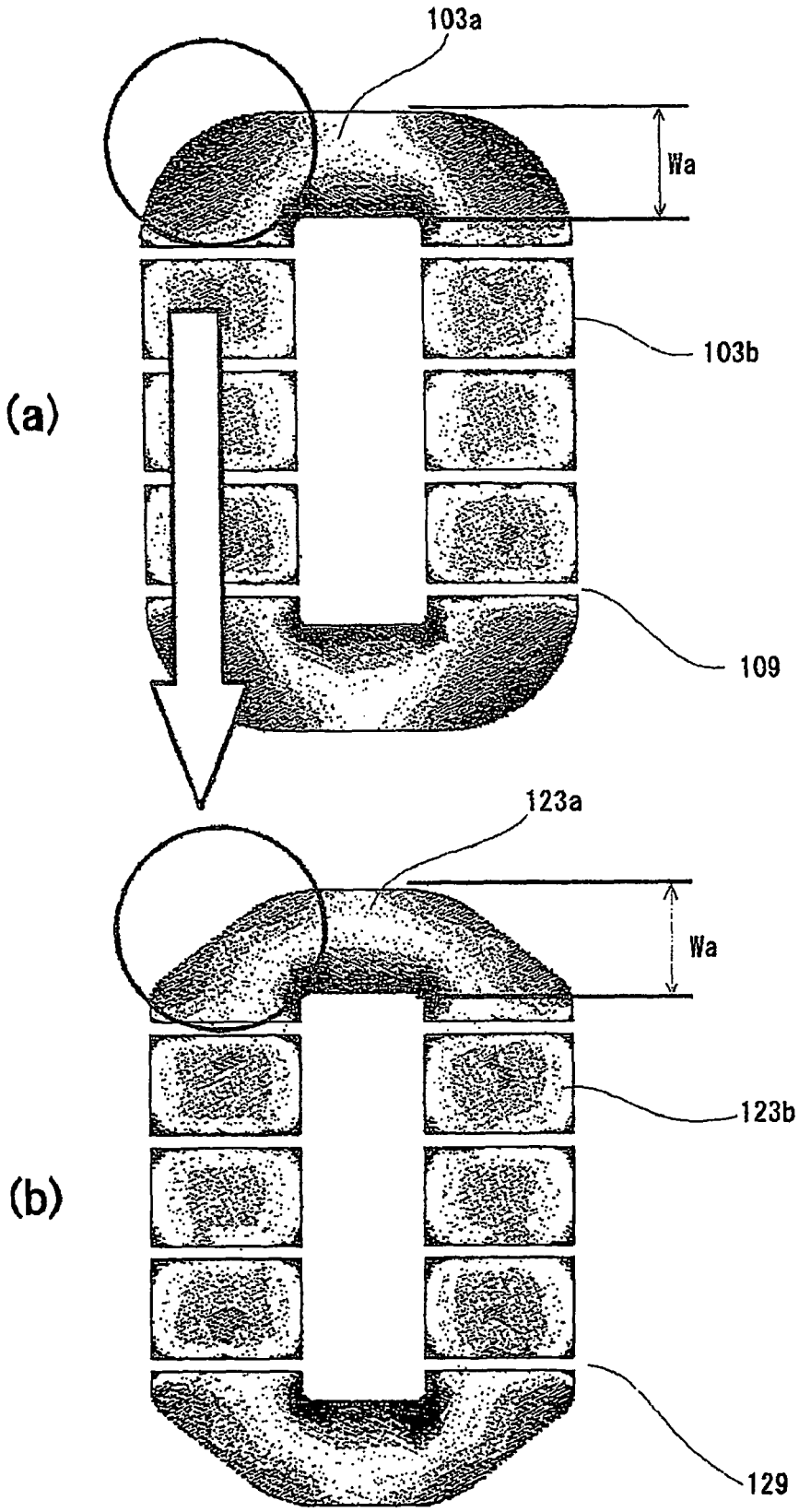
FIG. 17(*a*) is a diagram showing a state of magnetic distribution of a core of a reactor part according to the example 6 of the first embodiment of the present invention and FIG. 17(*b*) is a diagram showing a state of magnetic distribution of a core of a reactor part according to the example 1 of the fourth embodiment.
Figure 18:
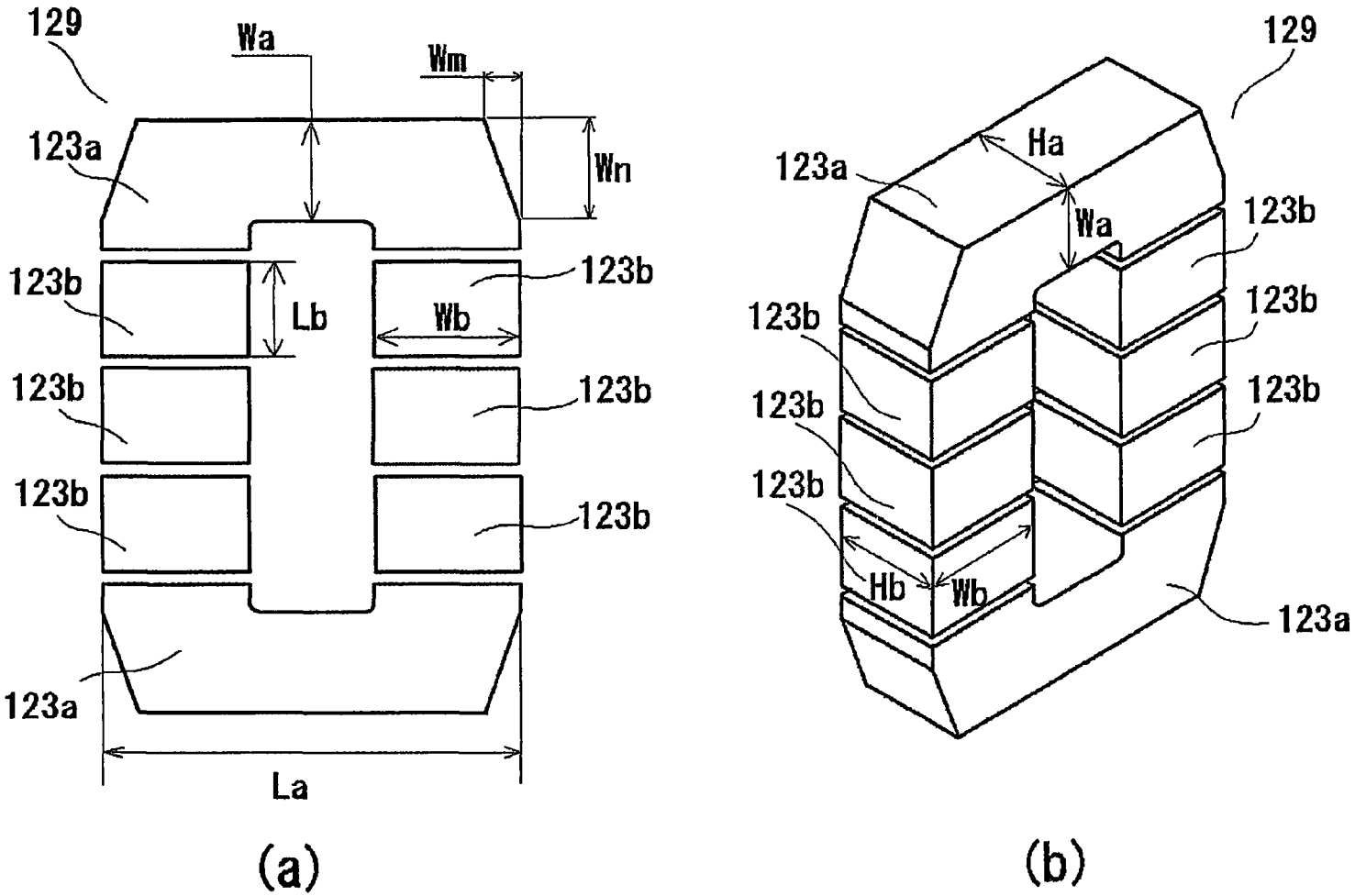
FIG. 18 is a diagram showing a shape of a core of a reactor part of the modified example 1 of the fourth embodiment of the present invention and FIG. 18(*a*) is its plan view and FIG. 18(*b*) is its perspective view.
Figure 19:
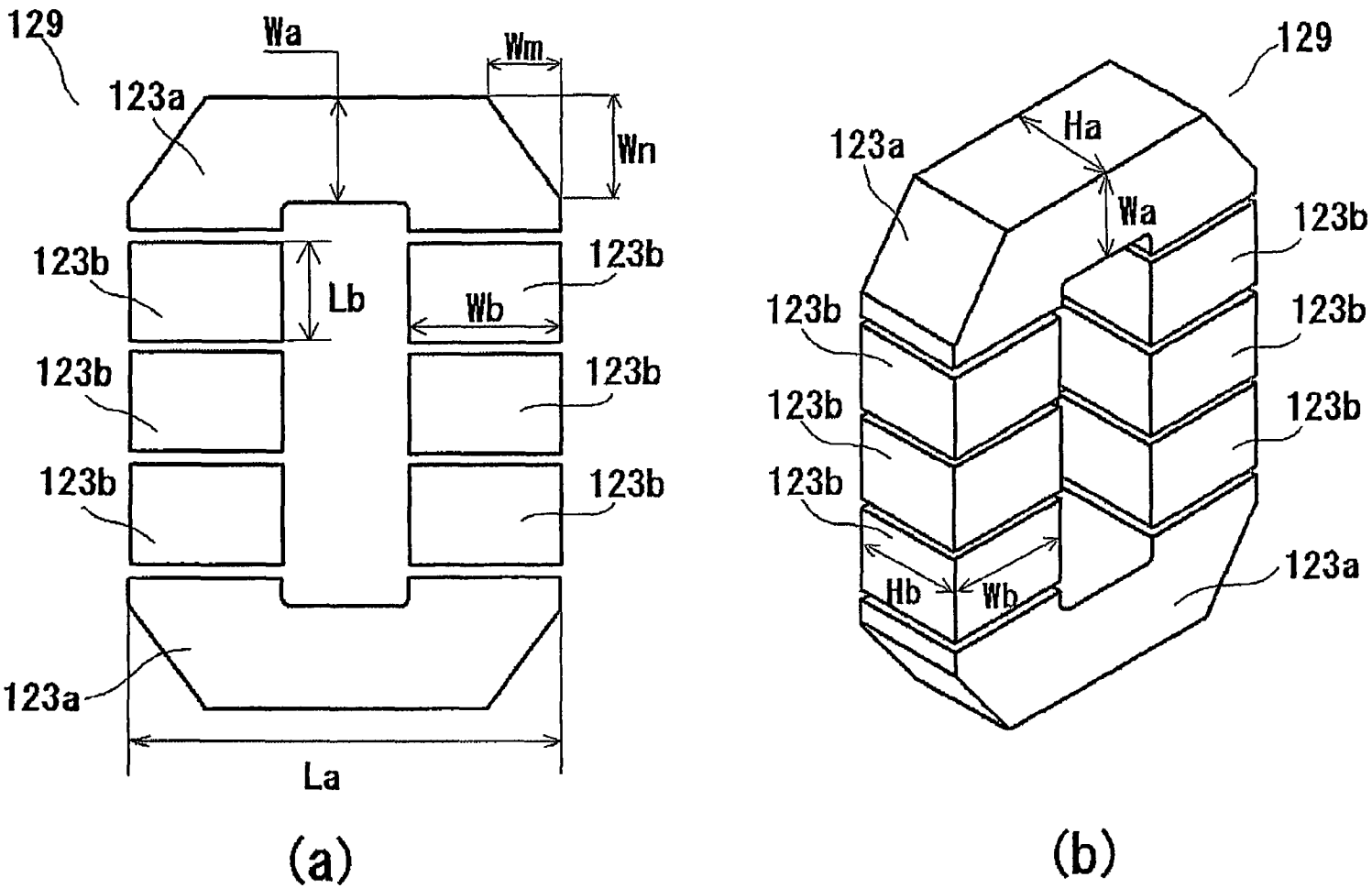
FIG. 19 is a diagram showing a shape of a core of a reactor part of the modified example 2 of the fourth embodiment of the present invention and FIG. 19(*a*) is its plan view and FIG. 19(*b*) is its perspective view.
Figure 20:
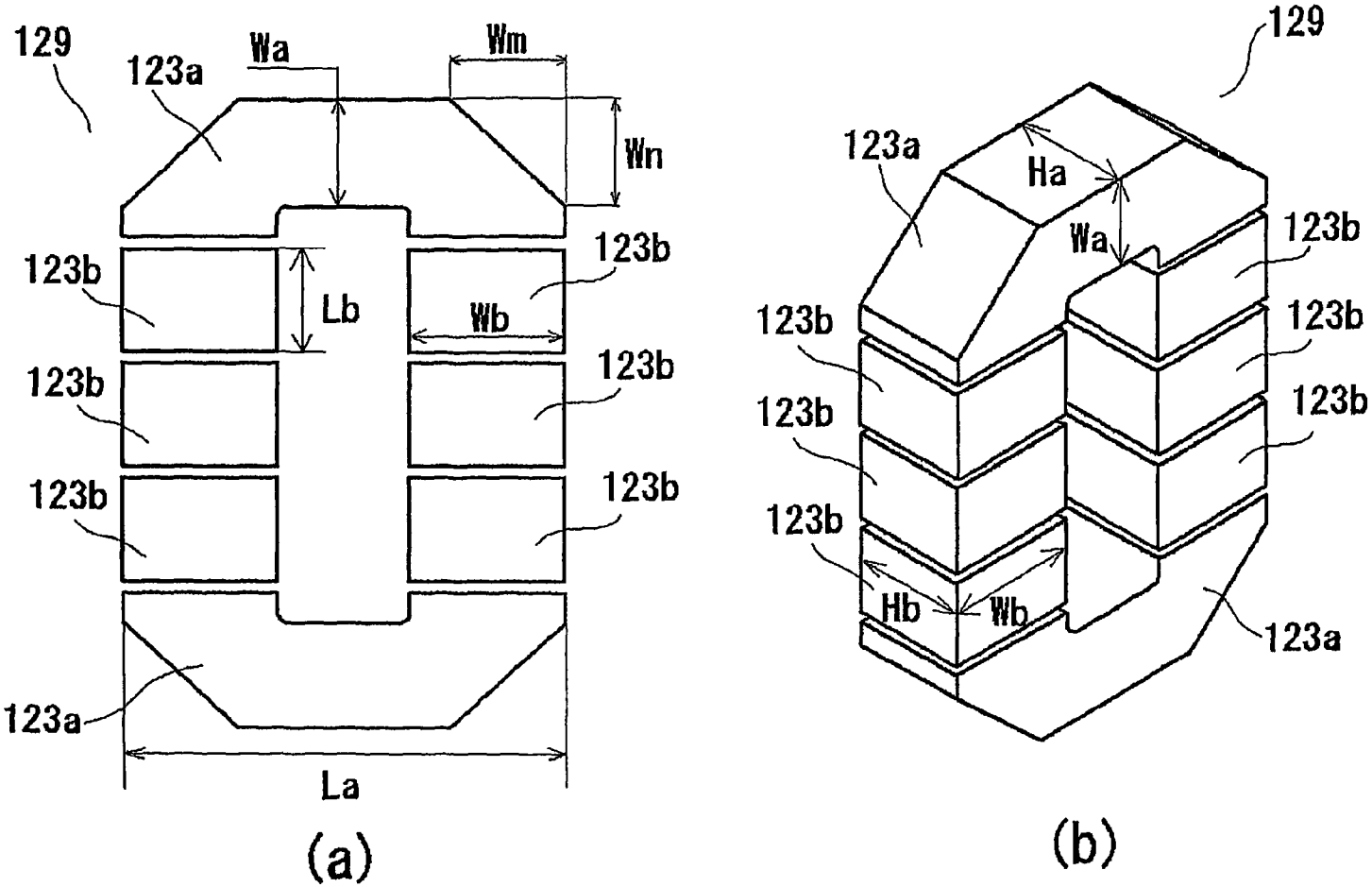
FIG. 20 is a diagram showing a shape of a core of a reactor part of the modified example 3 of the fourth embodiment of the present invention and FIG. 20(*a*) is its plan view and FIG. 20(*b*) is its perspective view.
Figure 21:
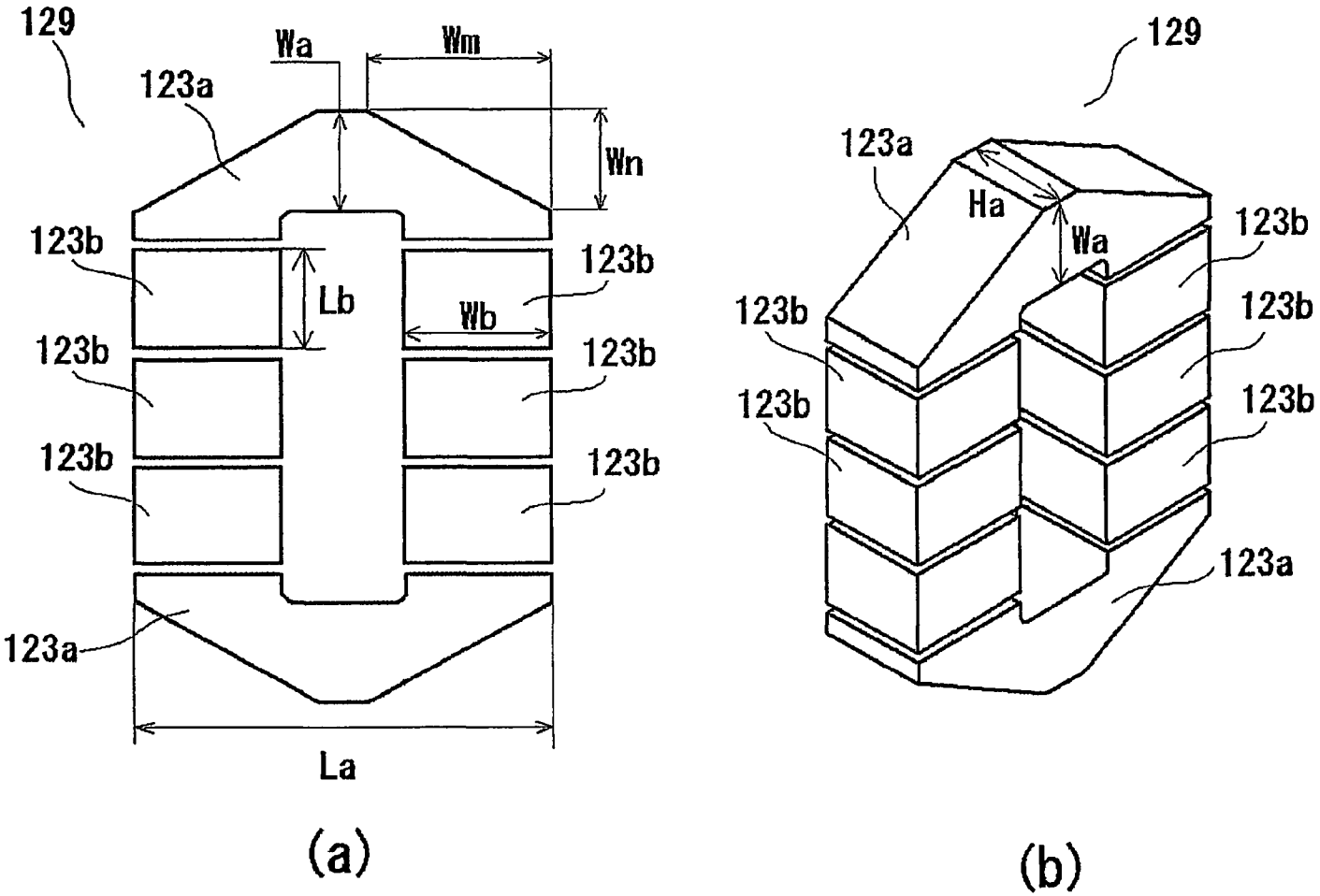
FIG. 21 is a diagram showing a shape of a core of a reactor part of the modified example 4 of the fourth embodiment of the present invention and FIG. 21(*a*) is its plan view and FIG. 21(*b*) is its perspective view.
Figure 22:
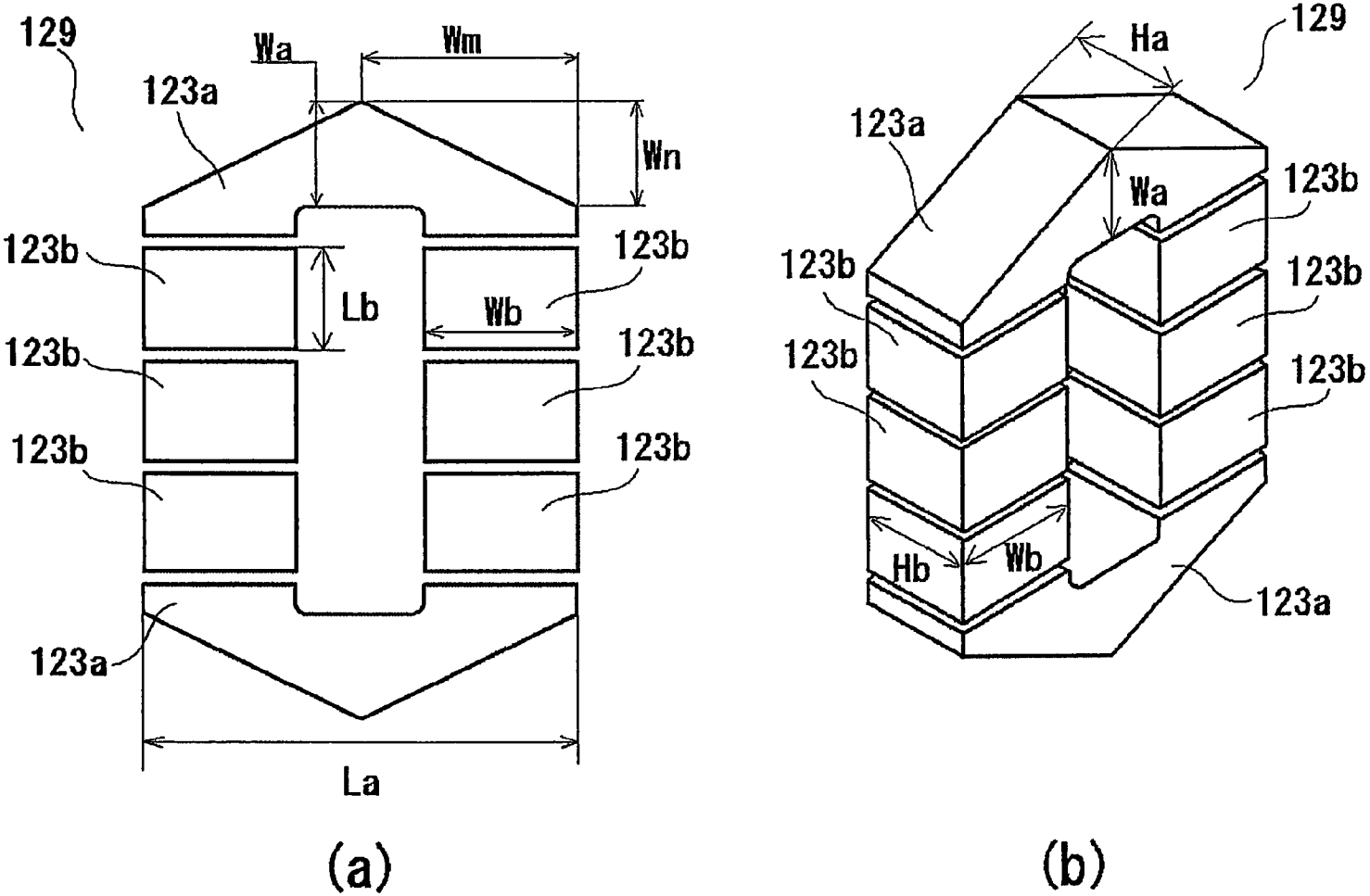
FIG. 22 is a diagram showing a shape of a core of a reactor part of the modified example 5 of the fourth embodiment of the present invention and FIG. 22(*a*) is its plan view and FIG. 22(*b*) is its perspective view.
Figure 23:
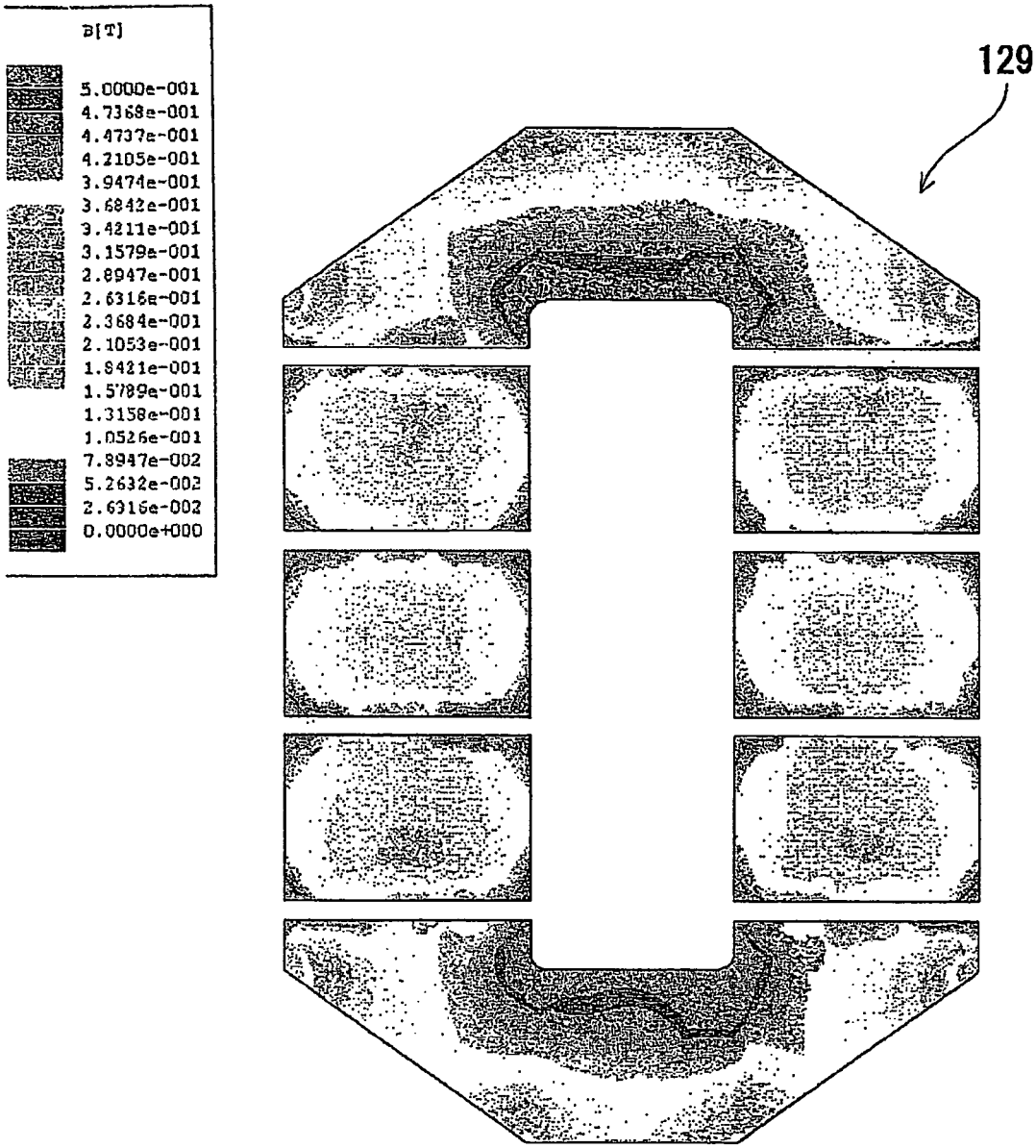
FIG. 23 is a diagram showing a state of magnetic distribution of a core of a rector part according to the example 1 of the fourth embodiment of the present invention.
Figure 24:
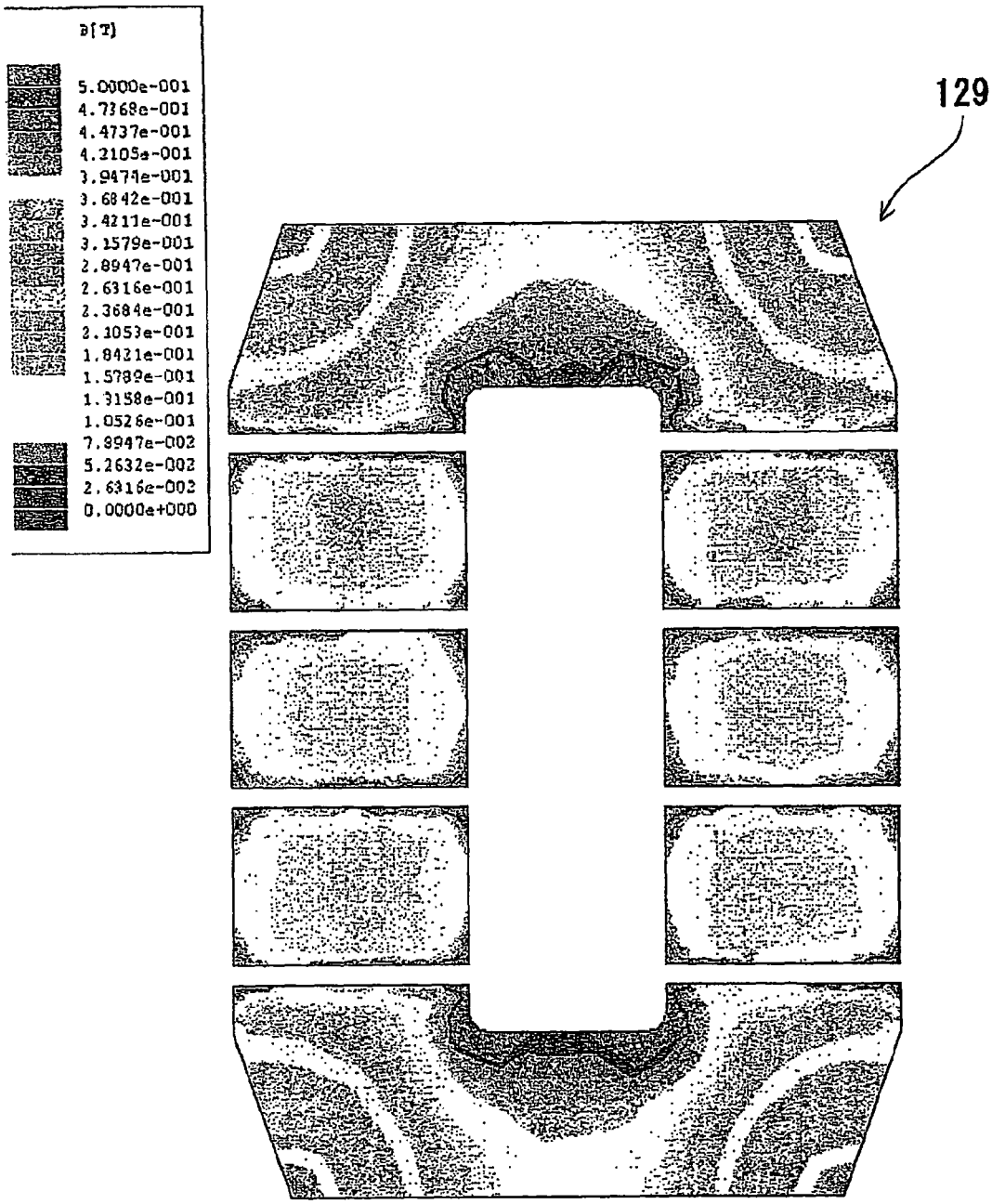
FIG. 24 is a diagram showing a state of magnetic distribution of a core of a rector part according to the modified example 1 of the fourth embodiment of the present invention.
Figure 25:
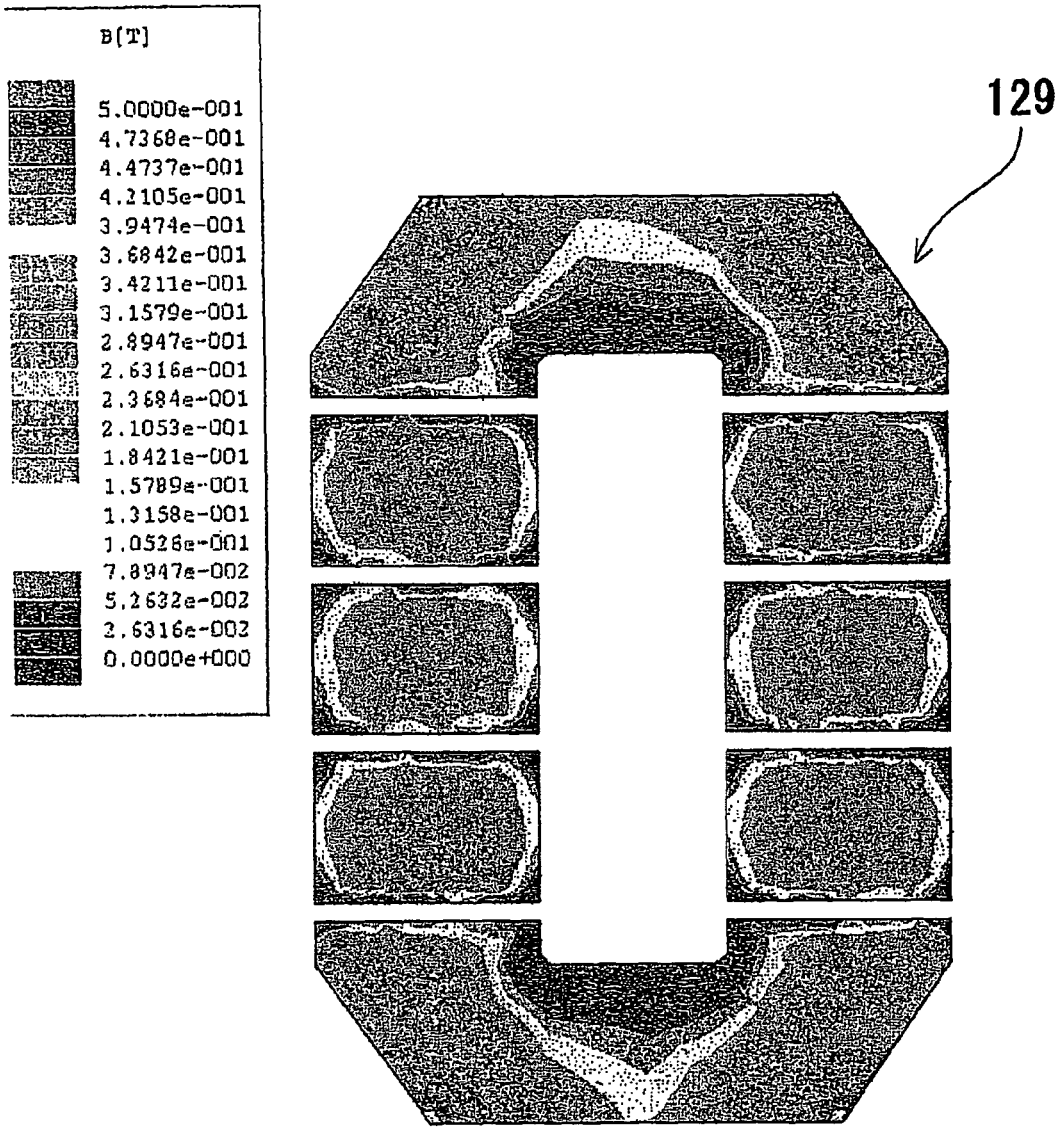
FIG. 25 is a diagram showing a state of magnetic distribution of a core of a rector part according to the modified example 2 of the fourth embodiment of the present invention.
Figure 26:
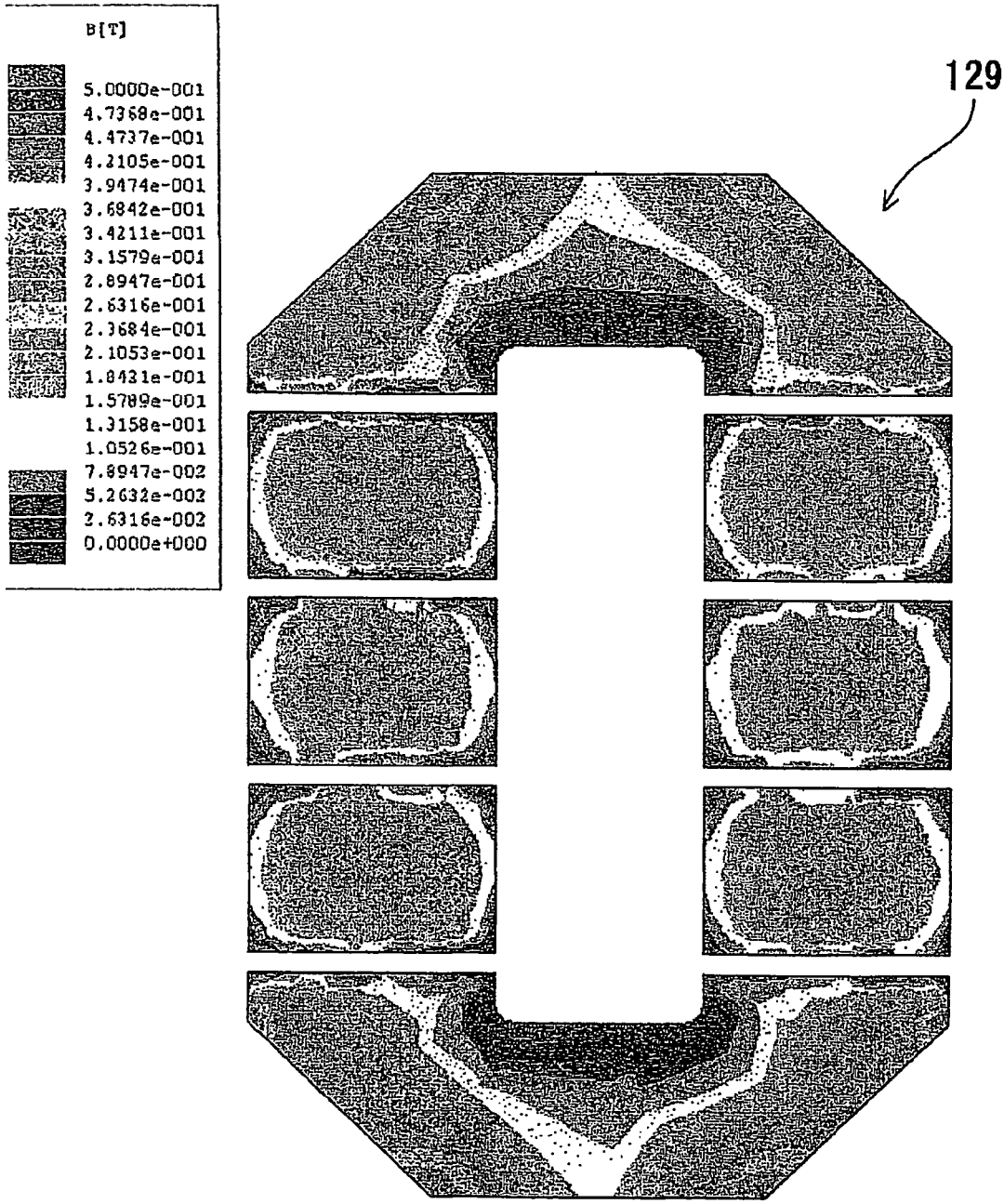
FIG. 26 is a diagram showing a state of magnetic distribution of a core of a rector part according to the modified example 3 of the fourth embodiment of the present invention.
Figure 27:
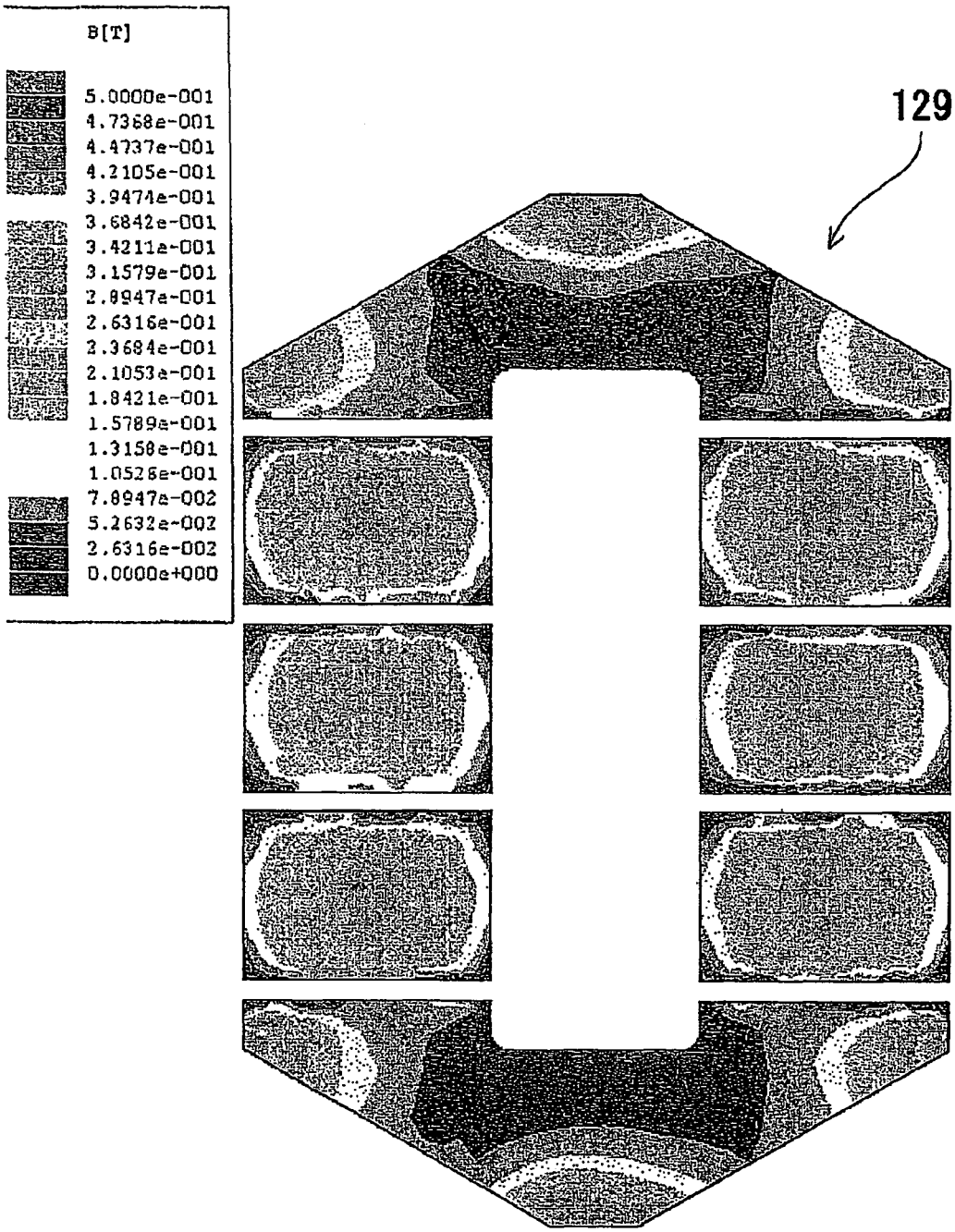
FIG. 27 is a diagram showing a state of magnetic distribution of a core of a rector part according to the modified example 4 of the fourth embodiment of the present invention.
Figure 28:
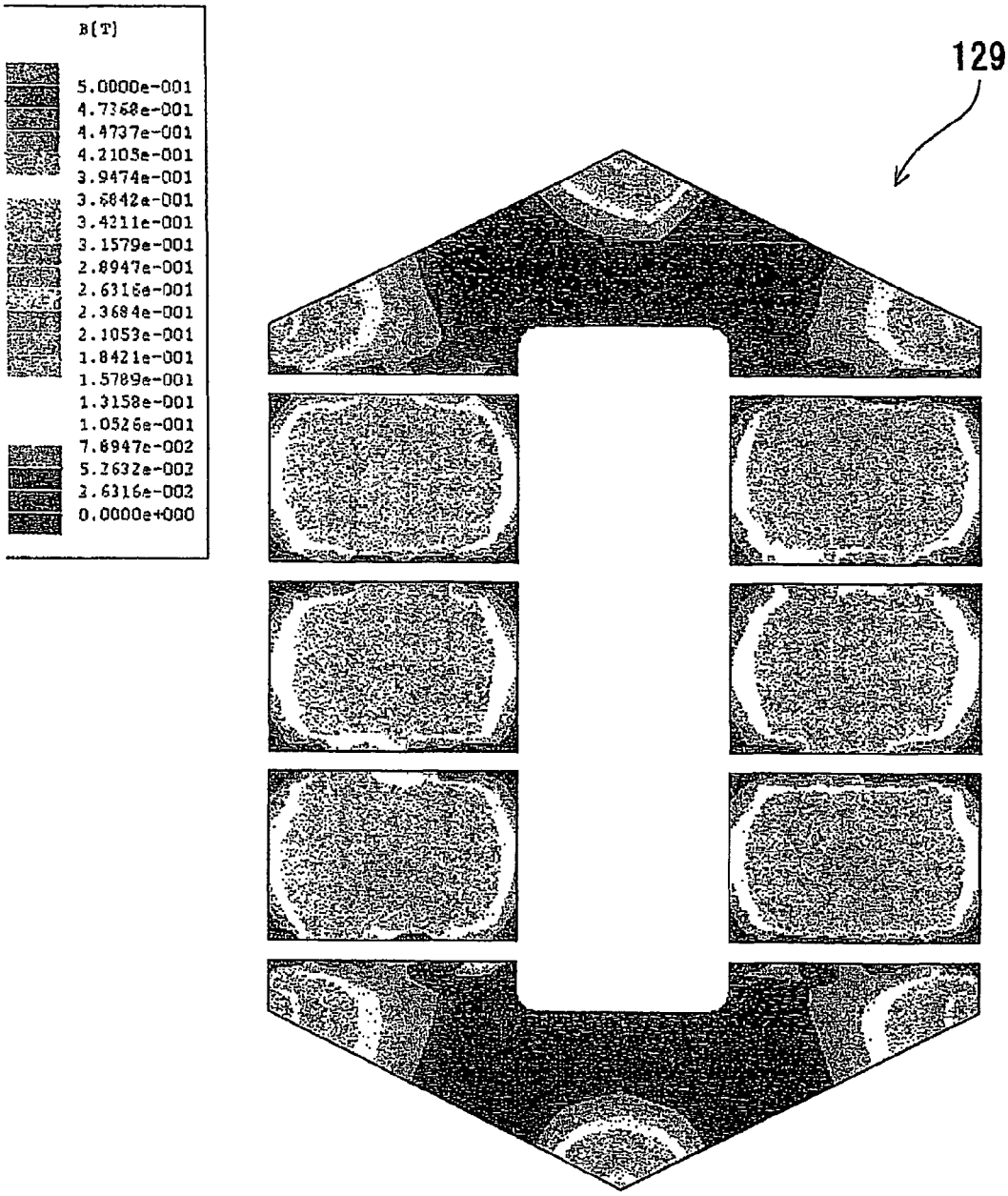
FIG. 28 is a diagram showing a state of magnetic distribution of a core of a rector part according to the modified example 5 of the fourth embodiment of the present invention.

The invention claimed is:

1. A reactor part, comprising:

at least a winding and a magnetic substance core, wherein said core comprises:

a pair of winding portions around each of which said winding is wound; and a non-winding portion around which no winding is wound, and wherein a cross-sectional area in a direction orthogonal to a magnetic path of said non-winding portion of said core is made smaller than a cross-sectional area in a direction orthogonal to a magnetic path of said each of winding portions; and wherein a cross-section area of said non-winding portion is about 0.76 times to about 0.67 times a cross-sectional area of said each of winding portions.

2. A reactor part, comprising:

at least a winding and a magnetic substance core, wherein said core comprises:

a pair of winding portions around each of which said winding is wound; and a non-winding portion around which no winding is wound, wherein said each of winding portions has at least two magnetic substance blocks each having a rectangular and plane shape arranged in parallel with an interval interposed between one another, wherein two non-winding portions, each comprising an approximately trapezoidal or triangular magnetic substance block, are arranged in a manner in which said two approximately trapezoidal or triangular magnetic substance blocks of said non-winding portion sandwich said magnetic substance blocks comprising said each of winding portions by each of approximately trapezoidal or triangular bottoms of said non-winding portions so as to be faced one another, and wherein a cross-sectional area in a direction orthogonal to a magnetic path of an approximately trapezoidal or triangular crest portion of each of said magnetic substance blocks making up said non-winding portion is made smaller than a cross-sectional area in a direction orthogonal to a magnetic path of each of said magnetic substance blocks making up said each of winding portions; and wherein a cross-sectional area of said non-winding portion is about 0.76 times to about 0.67 times across-sectional area of said each of winding portions.

3. The reactor part according to claim 1, wherein said core is divided into eight portions with a magnetic gap interposed among blocks.

4. A vehicle-mounted type reactor comprising the reactor part of claim 1.

5. The reactor part according to claim 1, wherein said core is divided into eight portions with a magnetic gap interposed among blocks.

6. The reactor part according to claim 2, wherein said core is divided into eight portions with a magnetic gap interposed among blocks.

7. A vehicle-mounted type reactor comprising the reactor part of claim 1.

8. A vehicle-mounted type reactor comprising the reactor part of claim 2.

9. A vehicle-mounted type reactor comprising the reactor part of claim 4.

10. The reactor part according to claim 1, wherein one of said pair of winding portions is symmetrical to another one of said pair of winding portions.

11. The reactor part according to claim 10, wherein said non-winding portion comprises a pair of symmetrical non-winding sections, each of said non-winding sections extending from said one of said pair of winding portions to said another one of said pair of winding portions.

12. The reactor part according to claim 1, wherein the cross-sectional area in the direction orthogonal to the magnetic path of said non-winding portion changes across the non-winding portion.

13. The reactor part according to claim 2, wherein one of said pair of winding portions is symmetrical to another one of said pair of winding portions.

14. The reactor part according to claim 13, wherein said two non-winding portions are symmetrical.

15. The reactor part according to claim 14, wherein said each of said two non-winding portions extends from said one of said pair of winding portions to said another one of said pair of winding portions.

16. The reactor part according to claim 2, wherein the cross-sectional area in the direction orthogonal to the magnetic path of said magnetic substance blocks of said non-winding portion changes across the non-winding portion.

17. A reactor part, comprising:

a magnetic substance core, comprising:

a pair of symmetrical winding portions around each of which a winding is wound; and a pair of non-winding portions around each of which no winding is wound, each of said pair of non-winding portions extending between said pair of symmetrical winding portions, and wherein a non-uniform cross-sectional area of said each of non-winding portions in a direction orthogonal to a magnetic path of said each of non-winding portions is smaller than a cross-sectional area of said each of winding portions in a direction orthogonal to a magnetic path of said each of winding portions; and wherein a cross-sectional area of said non-winding portion is about 0.76 times to about 0.67 times across-sectional area of said each of winding portions.

* * * * *